US008474815B2

(12) United States Patent
Takahashi

(10) Patent No.: US 8,474,815 B2
(45) Date of Patent: Jul. 2, 2013

(54) TRANSPORT DEVICE, IMAGE FORMING DEVICE, TRANSPORT METHOD, AND RECORDING MEDIUM

(75) Inventor: Minoru Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 395 days.

(21) Appl. No.: 12/876,294

(22) Filed: Sep. 7, 2010

(65) Prior Publication Data

US 2011/0064500 A1 Mar. 17, 2011

(30) Foreign Application Priority Data

Sep. 11, 2009 (JP) ..... 2009-210982

(51) Int. Cl.
*B65H 5/34* (2006.01)

(52) U.S. Cl.
USPC ..... 271/270; 271/264

(58) Field of Classification Search
USPC ..... 271/264, 270
See application file for complete search history.

(56) References Cited

U.S. PATENT DOCUMENTS

| | | | |
|---|---|---|---|
| 6,234,470 | B1 | 5/2001 | Okitsu et al. |
| 2008/0237967 | A1 | 10/2008 | Suzuki et al. |

FOREIGN PATENT DOCUMENTS

| | | |
|---|---|---|
| JP | 2007-072289 | 3/2007 |
| JP | 2008-024520 | 2/2008 |
| JP | 2008-105772 | 5/2008 |
| JP | 2008-158076 | 7/2008 |

*Primary Examiner* — Michael McCullough
(74) *Attorney, Agent, or Firm* — IPUSA, PLLC

(57) ABSTRACT

In a transport device, a first speed control unit controls a rotating speed of a first roller driving unit to reach a first target speed, and a second speed control unit controls a rotating speed of a second roller driving unit to reach a second target speed. The second speed control unit is arranged to perform, when a print medium is transported by both a first transport roller unit and a second transport roller unit, a follower control having a response sensibility to speed fluctuations in a predetermined frequency region of a control system, which is smaller than a response sensibility when the print medium is transported by the second transport roller unit solely.

14 Claims, 17 Drawing Sheets

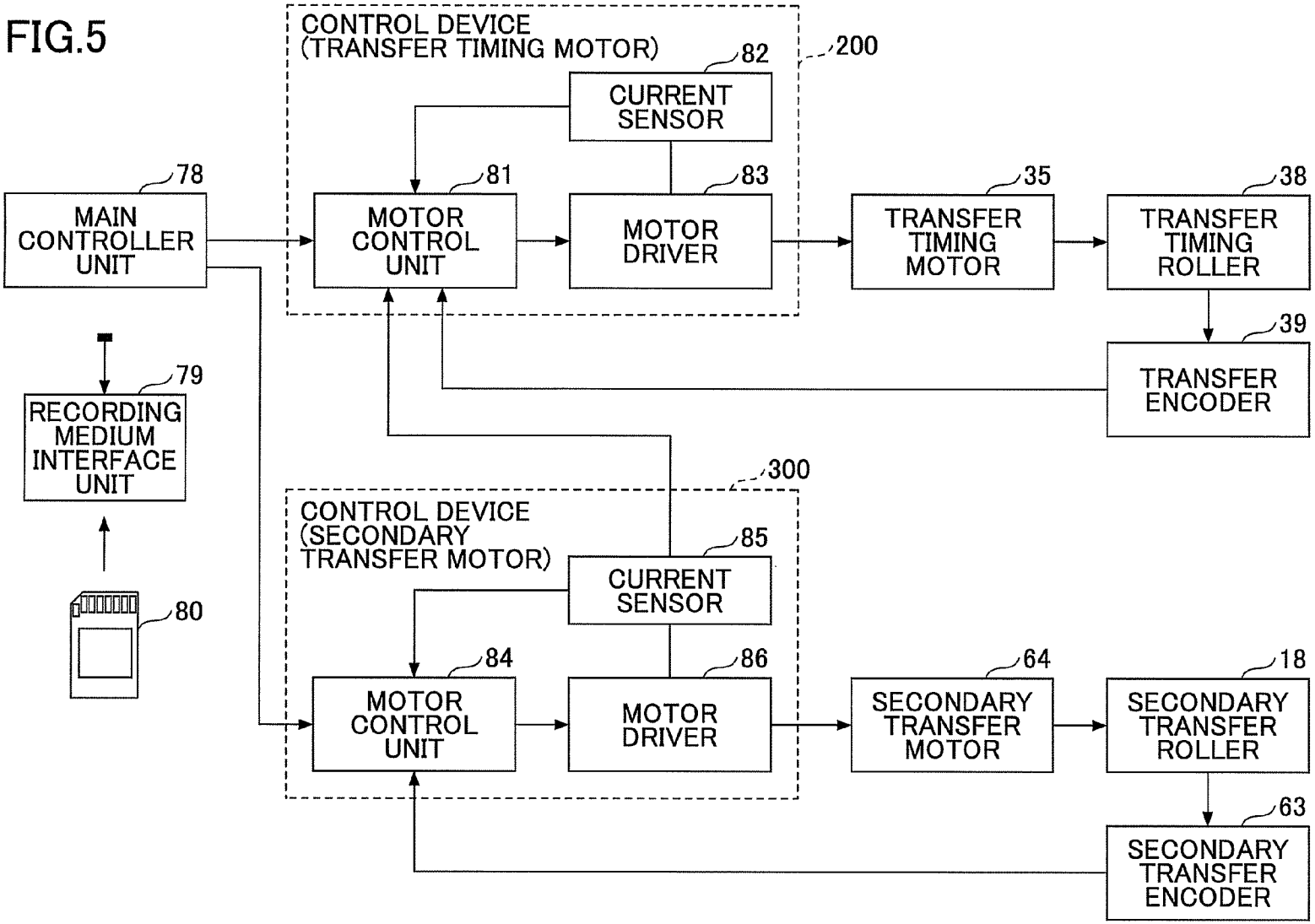
FIG.5
MAIN CONTROLLER UNIT
78
RECORDING MEDIUM INTERFACE UNIT
79
80
CONTROL DEVICE (TRANSFER TIMING MOTOR)
200
CURRENT SENSOR
82
MOTOR DRIVER
83
MOTOR CONTROL UNIT
81
TRANSFER TIMING MOTOR
35
TRANSFER TIMING ROLLER
38
TRANSFER ENCODER
39
CONTROL DEVICE (SECONDARY TRANSFER MOTOR)
300
CURRENT SENSOR
85
MOTOR DRIVER
86
MOTOR CONTROL UNIT
84
SECONDARY TRANSFER MOTOR
64
SECONDARY TRANSFER ROLLER
18
SECONDARY TRANSFER ENCODER
63

TRANSPORT DEVICE, IMAGE FORMING DEVICE, TRANSPORT METHOD, AND RECORDING MEDIUM

BACKGROUND OF THE INVENTION

1. Field of the Invention

The present disclosure generally relates to a transport device which transports a print medium, and more particularly to a transport device, an image forming device, a transport method, and a recording medium which are adapted to control a rotating speed of a transport roller unit which transports a print medium.

2. Description of the Related Art

In an image forming device, a transfer unit transfers a toner image formed on an intermediate transfer belt or a photoconductor drum, to a print medium. Subsequently, the toner image is fixed to the print medium by applying pressure and heat thereto. In the transfer unit, the print medium is pressed on the intermediate transfer belt or the photoconductor drum with a transfer roller. A transfer timing roller or a registration roller (upstream roller) is disposed at an upstream location of the transfer unit along a transport path.

When a size of a print medium is larger than a predetermined size, the print medium may be in an overlapping condition that it extends from a secondary transfer roller (downstream roller) to the upstream roller. The rotating speed of the downstream roller and the rotating speed of the upstream roller are controlled independently of each other. If the print medium is in an overlapping condition that it extends from the downstream roller to the upstream roller, tension in the print medium by an upstream roller of a fixing unit or compression in the print medium by the downstream roller may occur depending on a difference between the rotating speeds of these rollers. In the following, this phenomenon will be referred to as torque interference.

If torque interference between the two rollers occurs, either the upstream roller or the downstream roller slips, which causes deterioration of image quality or a color deviation. In particular, if a weight of unit area of a print medium is large (e.g., a cardboard sheet) and a peripheral speed of the upstream roller is larger than a peripheral speed of the downstream roller, the possibility that the downstream roller be made to slip by compression in the print medium by the downstream roller becomes high.

For example, Japanese Laid-Open Patent Publication No. 2008-158076 discloses an image forming device in which a print medium in a transport path in a fixing device is formed to have a loop amount. This image forming device is arranged to correct the rotating speed of a fixing roller of the fixing device at intervals of a predetermined time based on a result of comparison of a detected loop amount of the print medium and a proper loop amount.

Moreover, in the image forming device according to the related art, the force of a pair of upstream rollers to hold a print medium is reduced when the print medium is transported to reach the downstream roller, in order to cancel torque interference between the upstream rollers and the downstream roller.

According to this technique, even when a print medium is in an overlapping condition that it extends from the downstream roller to the upstream rollers, the print medium is not held by the upstream rollers. It is possible to prevent deterioration of image quality from occurring due to the torque interference.

However, in the image forming device of Japanese Laid-Open Patent Publication No. 2008-158076, the proper loop amount must be determined and stored beforehand. There is a problem that the amount of correction of the rotating speed of the fixing roller is dependent on the stored proper loop amount.

Usually, the amount of torque interference between the two rollers varies according to changes of the humidity of the environment on a daily basis and occasional changes of the image forming device. It is difficult to determine a proper loop amount beforehand. Hence, there is no guarantee that the amount of correction to the rotating speed of the fixing roller controlled as a result of the comparison between the detected loop amount and the loop amount is exact. In particular, when the print medium is a cardboard sheet, it is difficult to form a loop of the print medium in many cases.

In the image forming device according to the related art, which is arranged to reduce the force of the pair of upstream rollers to hold a print medium, there is a problem that the image forming device requires an actuator for adjusting the spacing of the upstream rollers, which increases the cost. In addition, it is difficult to modify the image forming device to have an additional space for installing the actuator.

SUMMARY OF THE PRESENT DISCLOSURE

In one aspect, the present disclosure provides a transport device, an image forming device, a transport method, and a recording medium which are capable of reducing torque interference between a downstream roller and an upstream roller.

In an embodiment which solves or reduces one or more of the above-mentioned problems, the present disclosure provides a transport device including: a first transport roller unit that transports a sheet-like print medium along a transport path in a transporting direction; a second transport roller unit that is disposed at one of a downstream location and an upstream location of the first transport roller unit along the transport path and transports the print medium in the transporting direction; a first roller driving unit that rotates the first transport roller unit; a second roller driving unit that rotates the second transport roller unit; a first speed control unit that controls a rotating speed of the first roller driving unit to reach a first target speed; and a second speed control unit that controls a rotating speed of the second roller driving unit to reach a second target speed, wherein the second speed control unit is arranged to perform, when the print medium is transported by both the first transport roller unit and the second transport roller unit, a follower control having a response sensibility to speed fluctuations in a predetermined frequency region of a control system, which is smaller than a response sensibility when the print medium is transported by the second transport roller unit solely.

Other objects, features and advantages of the present disclosure will become more apparent from the following detailed description when read in conjunction with the accompanying drawings.

BRIEF DESCRIPTION OF THE DRAWINGS

FIG. 5 is a diagram illustrating the hardware composition of a control device.

DETAILED DESCRIPTION OF THE PREFERRED EMBODIMENTS

A description will be given of embodiments of the present disclosure with reference to the accompanying drawings.

Embodiment 1

The composition of an image forming device 100 of this embodiment will be described.

The image forming device 100 of this embodiment is arranged to control an upstream roller to operate as a follower roller of a downstream roller from a time a print medium transported by the upstream roller only has entered the downstream roller to a time the print medium is transported by the downstream roller only (or when the print medium is in an overlapping condition that it extends from the upstream roller to the downstream roller). Therefore, when the print medium is in an overlapping condition that it extends from the downstream roller to the upstream roller, the upstream roller is controlled to operate as a follower roller and it is possible to prevent the print medium from being compressed by the upstream roller, and it is possible to prevent occurrence of a slip on the upstream roller or the downstream roller.

In the following, the overlapping condition of a print medium means a condition in which the print medium is held by both the upstream roller and the downstream roller with a force that is larger than zero.

Figure 1:
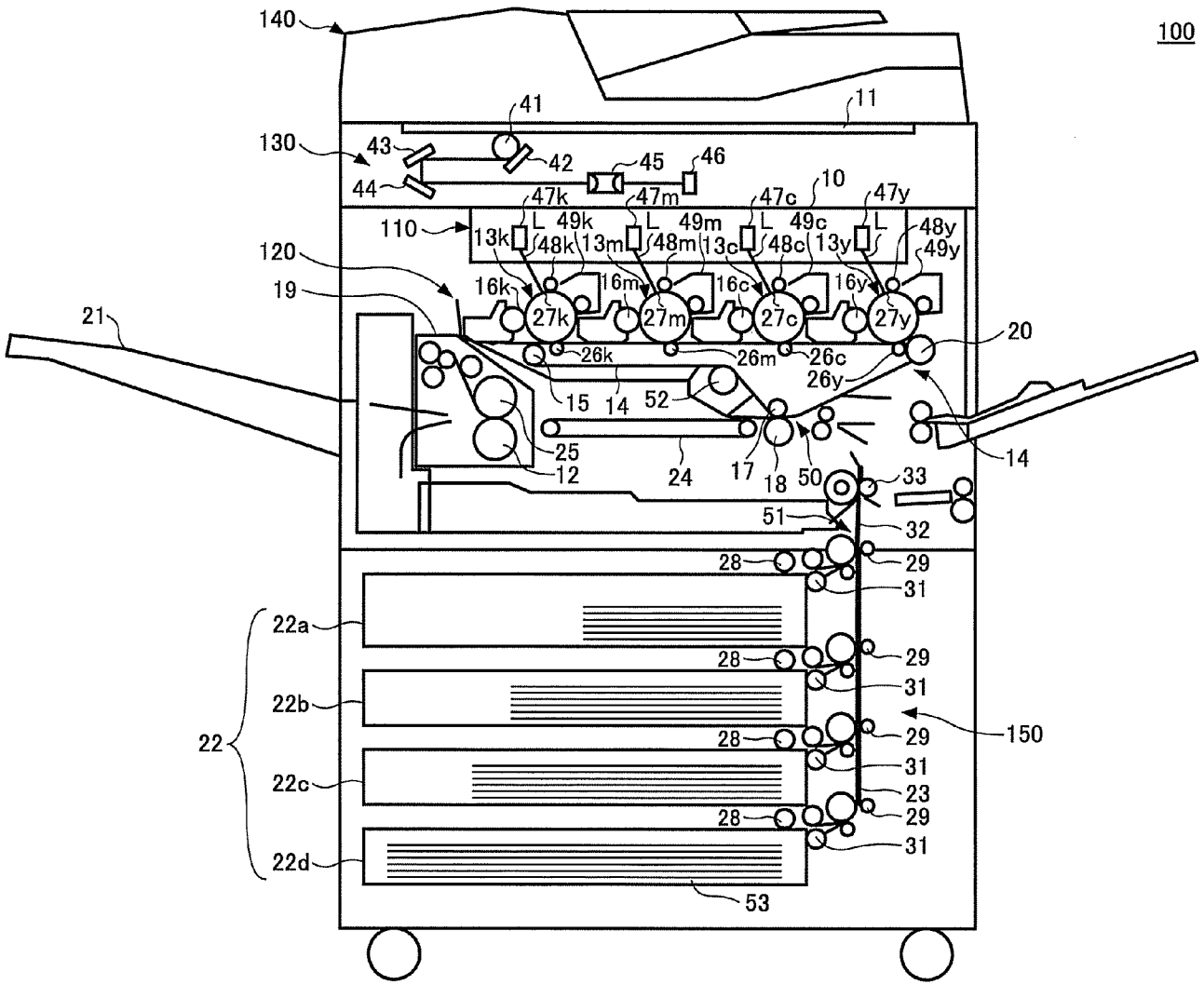
FIG. 1 is a diagram illustrating the composition of an image forming device.

FIG. 1 illustrates the composition of the image forming device 100 of this embodiment. The image forming device 100 includes an automatic document feeder (ADF) 140, an image reading unit 130, an image writing unit 110, an image formation unit 120, and a feeding unit 150.

The ADF 140 transports a document loaded on a document feeding base to a contact glass of the image reading unit 130. After image data of the document is read by the image reading unit 130, the ADF 140 ejects the document to a sheet output tray.

The image reading unit 130 includes a contact glass 11 on which a document is placed, and an optical scanning system. The optical scanning system includes an exposure lamp 41, a first mirror 42, a second mirror 43, a third mirror 44, a lens 45, and a full-color CCD (charge-coupled device) 46. The exposure lamp 41 and the first mirror 42 are arranged on a first carriage. When image data of the document is read, the first carriage is moved in a sub-scanning direction at a constant speed by a stepping motor. The second mirror 43 and the third mirror 44 are arranged on a second carriage. When image data of the document is read, the second carriage is moved by a stepping motor at a speed which is set to about ½ of the speed of the first carriage. When the first carriage and the second carriage are moved in this manner, the image surface of the document is optically scanned. The light beam indicating the read image data is focused on the light receiving surface of the full-color CCD 46 by the lens 45, and the full-color CCD 46 performs photoelectric conversion of the received light beam.

The image data of respective colors of red (R), green (G) and blue (B), obtained as a result of the photoelectric conversion by the full-color CCD 46, are supplied to an image processing unit (not illustrated in FIG. 1). The image processing unit performs A/D conversion of the image data to generate digital image signals. In the image processing unit, various kinds of image processing (gamma correction, color transformation, image dissociation, gray level correction, etc.) of the digital image signals are performed by the image processing unit.

In response to a copy request or a print request which is input by a user, the image writing unit 110 forms an electrostatic latent image of every color on a surface of a photoconductor drum. In the embodiment of FIG. 1, four photoconductor units 13 (including a photoconductor unit 13*y* for yellow, a photoconductor unit 13*m* for magenta, a photoconductor unit 13*c* for cyan, and a photoconductor unit 13*k* for black) are arranged side by side along the transporting direction of an intermediate transfer belt 14. In each of the photoconductor units 13*y*, 13*m*, 13*c* and 13*k*, one of photoconductor drums 27*y*, 27*m*, 27*c* and 27*k* (which are drum-like image supports), one of charging units 48*y*, 48*m*, 48*c* and 48*k* (which electrically charge a corresponding surface of the photoconductor drums 27*y*, 27*m*, 27*c* and 27*k* respectively), one of exposure units 47*y*, 47*m*, 47*c* and 47*k*, one of developing units 16*y*, 16*m*, 16*c* and 16*k*, and one of cleaning units 49*y*, 49*m*, 49*c* and 49*k* are arranged.

For example, in the embodiment of FIG. 1, each of the exposure units 47*y*, 47*m*, 47*c* and 47*k* includes an LED (light emitting diode) array and a lens array arranged in the shaft direction (main scanning direction) of one of the photoconductor drums 27*y*, 27*m*, 27*c* and 27*k*. Each of the exposure units 47*y*, 47*m*, 47*c* and 47*k* causes the LED to emit light in accordance with the image data of each color obtained as the result of the photoelectric conversion of each color, to form an electrostatic latent image on the surface of one of the photoconductor drums 27*y*, 27*m*, 27*c* and 27*k*.

In each of the developing units 16*y*, 16*m*, 16*c* and 16*k*, a developing roller containing a toner is rotated to supply the toner to the electrostatic latent image formed on one of the photoconductor drums 27*y*, 27*m*, 27*c* and 27*k* so that a toner image of each color is formed thereon. The toner image formed on one of the photoconductor drums 27*y*, 27*m*, 27*c* and 27*k* is transferred to an intermediate transfer belt 14 at a location (primary transfer position) where the intermediate transfer belt 14 is in contact with the one of the photoconductor drums 27*y*, 27*m*, 27*c* and 27*k*. In each of the photoconductor drums 27*y*, 27*m*, 27*c* and 27*k*, one of intermediate transfer rollers 26*y*, 26*m*, 26*c* and 26*k* is arranged to face the one of the photoconductor drums 13*y*, 13*m*, 13*c* and 13*k* via the intermediate transfer belt 14 respectively. Each of the intermediate transfer rollers 26*y*, 26*m*, 26*c* and 26*k* is respectively made to contact the inner circumference surface of the intermediate transfer belt 14 to cause the intermediate transfer belt 14 to contact the surface of each photoconductor. By supplying the voltage to each of the intermediate transfer rollers 26*y*, 26*m*, 26*c* and 26*k*, an intermediate transfer electric field is generated for enabling the toner image on each of the photoconductor drums 27*y*, 27*m*, 27*c* and 27*k* to be transferred to the intermediate transfer belt 14. By the action of the intermediate transfer electric field, the toner image of each color is formed on the intermediate transfer belt 14. The toner images of the respective colors are transferred and superimposed so that a full color toner image is formed on the intermediate transfer belt 14.

When the imaging and transferring of the toner images of the respective colors are completed, a print medium 53 is fed from the sheet feed tray 22 at a timing matched with the movement of the intermediate transfer belt 14, and the full-color toner image from the intermediate transfer belt 14 is secondarily transferred to the print medium 53 by the secondary transfer part 50.

In order to feed the print medium 53, one of a first tray 22*a*, a second tray 22*b*, a third tray 22*c*, a fourth tray 22*d*, and a double-sided unit (not illustrated) is chosen. Each of these feed trays 22*a*-22*d* includes a feed roller 28 which feeds sequentially the top one of plural print media 53 accommodated in the feed tray, and a separation roller 31 which separates two or more print media 53 fed by the feed roller 28 into one print medium 53 and feeds the print medium 53 to the transport path 23. In this manner, transporting of the print medium 53 to the transport path 23 is started.

Although a plain-paper sheet is common as the print medium 53, the print medium 53 may be a sheet-like print medium, such as a glossy paper sheet, a cardboard sheet, a postcard sheet, an OHP sheet, or a film. Alternatively, a continuous sheet form may be used as the print medium 53.

The feed unit 150 is provided with two or more pairs of transporting rollers 29 which are appropriately disposed in the middle of the transport path 23. Each pair of transporting rollers 29 sends the print medium 53 transported from the sheet feed tray 22, to the downstream pair of transporting rollers 29 and a feed passage 32. The front end of the print medium 53 sent to the feed passage 32 is detected by a registration sensor 51. After a predetermined time elapses, the print medium 53 is brought in contact with the registration roller 33 and temporarily stayed at the registration roller 33. The registration roller 33 sends the print medium 53 to the location of the secondary transfer roller 18 at a predetermined timing (which is synchronized with a sub-scanning effective timing signal (FGATE)). The predetermined timing is the timing at which the full-color toner image is transported to the location of the secondary transfer roller 18 by the rotation of the intermediate transfer belt 14. A transfer timing roller 38 may be arranged at a downstream location of the registration roller 33.

A secondary transfer roller 18 is arranged to face a repulsion roller 17. The image forming device 100 is arranged to cause the secondary transfer roller 18 to contact the intermediate transfer belt 14 at the time of printing. The secondary transfer roller 18 is controlled by the secondary transfer motor 64 so that a peripheral speed of the secondary transfer roller 18 is equal to a surface speed of the intermediate transfer belt 14.

After the print medium 53 is separated from the intermediate transfer belt 14 by a separator (not illustrated), the print medium 53 is transported to a fixing unit 19 by a transport belt 24. The fixing unit 19 fixes the toner image to the print medium 53. At the time of single side printing, the print medium 53 after the fixing of the toner image is ejected to the sheet output tray 21.

The transport device according to the present disclosure is applicable to the image forming device of this embodiment. The image forming device according to the present disclosure is not restricted by a specific image formation method. The image forming device 100 of this embodiment uses an electrophotographic printing method as illustrated in FIG. 1. The transport device according to the present disclosure may also be applicable to a print-medium transport device of an inkjet type image forming device 100 as illustrated in FIG. 2.

Figure 2:
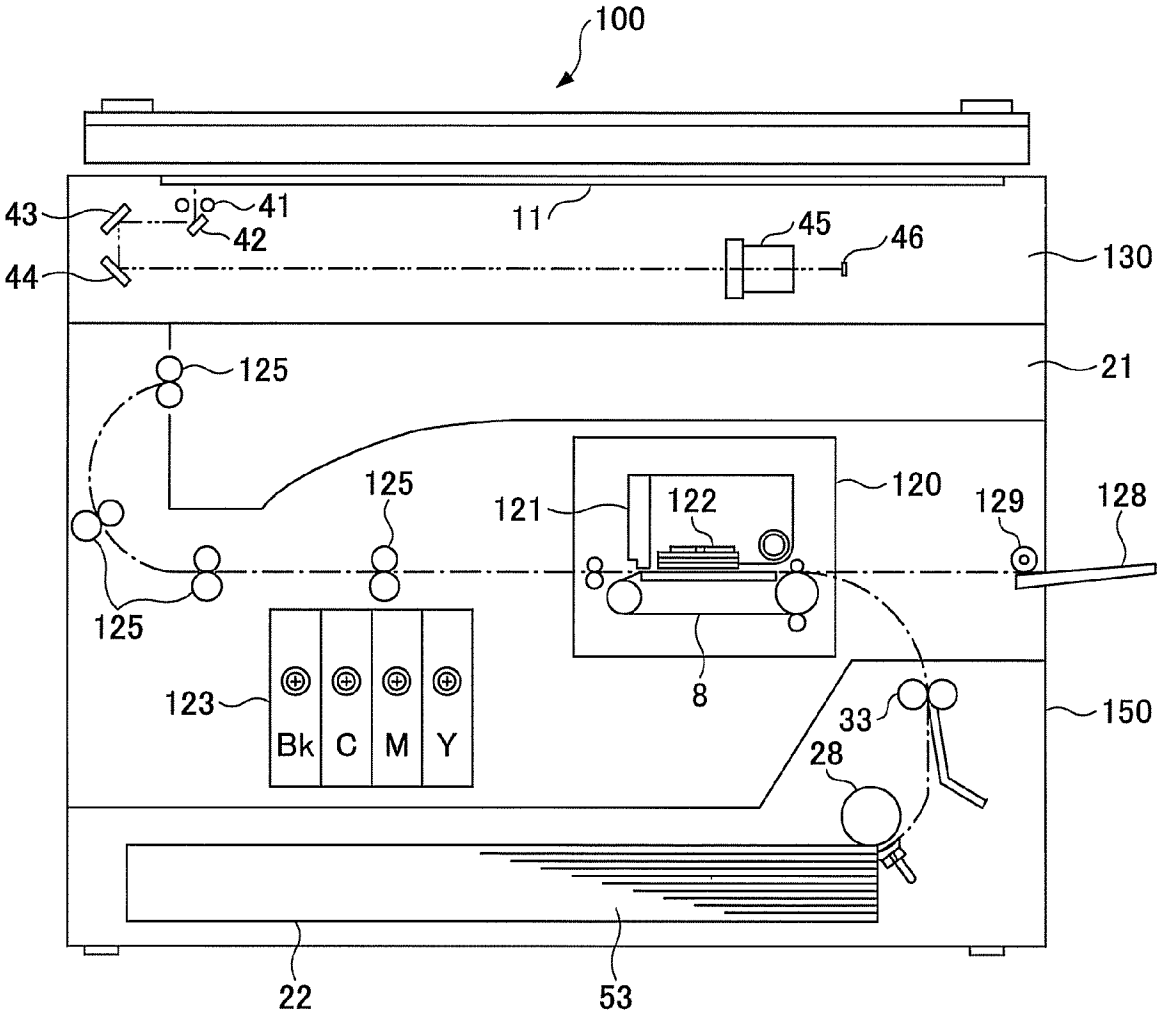
FIG. 2 is a diagram illustrating the composition of an inkjet type image forming device.

FIG. 2 illustrates the composition of an inkjet type image forming device 100. In FIG. 2, the elements which are essentially the same as corresponding elements in FIG. 1 are designated by the same reference numerals, and a description thereof will be omitted.

The image forming device 100 of FIG. 2 includes an image reading unit 130, an image formation unit 120, and a feeding unit 150. The image forming device 100 of this embodiment may include an ADF 140 as illustrated in FIG. 1. A sheet output tray 21 is arranged between the image reading unit 130 and the image formation unit 120.

A print medium 53 from a sheet feed tray 22 of the feeding unit 150 is transported to the sheet output tray 21 via a print medium transporting passage by a feed roller 28. The transport passage of the print medium 53 is indicated by the one-dotted chain line in FIG. 2.

A transport roller 125 is appropriately disposed along the print medium transporting passage. A manual bypass tray 128 is arranged at the right-side end portion of the image forming device 100. A print medium 53 from the manual bypass tray 128 is transported by a feed roller 129.

The print medium 53 fed from the sheet feed tray 22 temporarily stays at the registration roller 33. The registration roller 33 resumes transporting of the print medium 53 in accordance with a print start timing, and transports the print medium 53 to the electrostatic attraction belt 8. The print medium 53 is electrostatically attracted to the electrostatic attraction belt 8. The carriage 121 disposed over the electrostatic attraction belt 8 includes a print head 122 and is moved in a main scanning direction (which is perpendicular to the sheet of the drawing). The print head 122 discharges an ink drop to forms an image. Four print heads for discharging inks of respective colors (cyan, magenta, yellow and black) are provided in the carriage 121. Ink of each color from an ink cartridge 123 is supplied to the print head 122 via a feed tube (not illustrated).

The print medium 53 is transported in the sub-scanning direction by rotation of the electrostatic attraction belt 8. The image forming device 100 detects the amount of transport of the print medium 53 in the sub-scanning direction and moves the electrostatic attraction belt 8, so that accurate positioning of the print medium 53 is performed. With the print medium 53 at the positioned location, the image forming device 100 drives the print head 122 in accordance with an image signal, while moving the carriage 121 in one of the forward transport direction and the reverse transport direction. An ink drop is discharged from the print head 122 to the print medium 53 staying at the positioned location to print one line of an image on the print medium 53. After the print medium 53 is transported by a predetermined amount, the following line of the image is printed on the print medium 53. When a signal indicating that the rear end of the print medium 53 has arrived at the print region is received, the image forming device 100 terminates the printing operation and transports the print medium 53 to the sheet output tray 21.

In the image forming device 100 as illustrated, the carriage 121 is moved in one of the forward transport direction and the reverse transport direction. Alternatively, an image formation unit 120 of another type in which the line head is fixed may be provided. The print-medium transporting method is not limited to the electrostatic attraction method. Alternatively, an air attraction method which uses a vacuum pressure to attract a print medium may be used instead.

Also in the inkjet type image forming device 100 of FIG. 2, torque interference between the registration roller 33 and the electrostatic attraction belt 8 may take place. The transporting of the print medium 53 by the electrostatic attraction belt 8 requires precise positioning. If the torque interference becomes large, the time for the print medium 53 to arrive at a target position increases or a position error becomes large, which will lead to deterioration of image quality or a color deviation. If compression in the print medium 53 by the registration roller 33 takes place, the sheet transporting load will decrease, and the operating region of the driver or the drive transmission system will go into the nonlinear region. In this case, the control system becomes unstable similar to the print-medium transporting of the electro-photographic type image forming device. If the compressing force is large, the print medium 53 will slip on the electrostatic attraction belt 8.

Accordingly, applying the transport device according to the present disclosure to the inkjet type image forming device 100 of this embodiment makes it possible to prevent deterioration of image quality or a color deviation from occurring due to the torque interference.

Alternatively, the image formation unit 120 may be arranged by using a dye-sublimation type thermal transfer printing method or a dot impact printing method.

Figure 3:
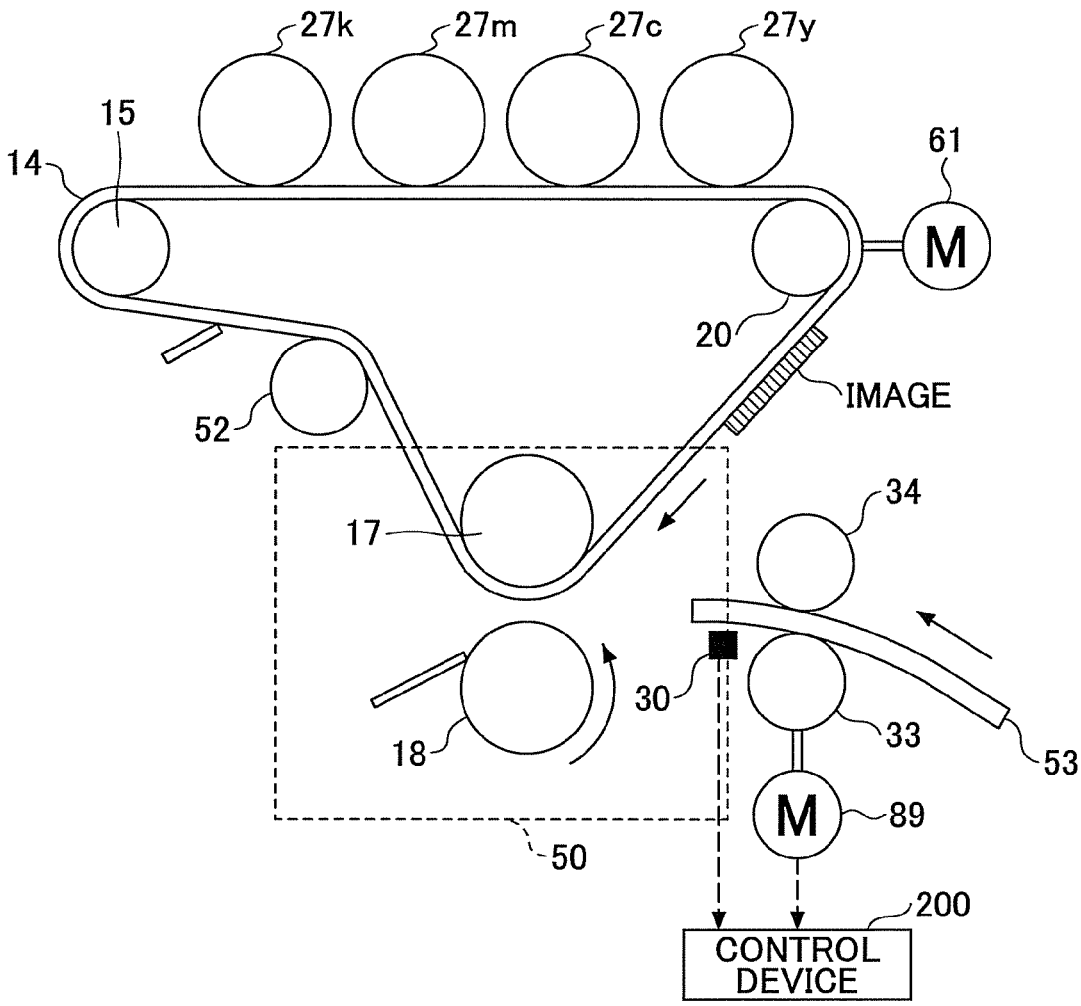
FIG. 3 is a diagram for explaining a structure of a secondary transfer part and a registration roller.

FIG. 3 is a diagram for explaining a structure of a secondary transfer part 50 and a registration roller 33. In FIG. 3, the elements which are essentially the same as corresponding elements in FIG. 1 are designated by the same reference numerals, and a description thereof will be omitted.

As illustrated in FIG. 3, the intermediate transfer belt 14 is rotated clockwise by the rotating force of the intermediate transfer roller 20. The intermediate transfer roller 20 is rotated by the intermediate transfer motor 61. A gear of the intermediate transfer roller 20 and a gear of the intermediate transfer motor 61 are engaged together and rotated around the same axle. The driving force of the intermediate transfer motor 61 is transmitted to the intermediate transfer roller 20 through the engagement of these gears so that the intermediate transfer roller 20 is rotated. A tension roller 15 and a repulsion roller 17 are disposed inside the intermediate transfer belt 14, and these rollers are follower rollers which are rotated by following the rotation of the intermediate transfer roller 20. The tension roller 15 is provided to give a predetermined tension to the intermediate transfer belt 14.

Alternatively, the intermediate transfer roller 20 may be arranged at the location of the tension roller 15.

A roller 52 is provided to adjust the fitting condition between the intermediate transfer belt 14 and the three rollers within the intermediate transfer belt 14.

The secondary transfer roller 18 is arranged so that the secondary transfer roller 18 may be pressed against the repulsion roller 17 via the intermediate transfer belt 14. Specifically, the secondary transfer roller 18 is energized in the direction toward the repulsion roller 17. At least when the print medium 53 passes through the portion between the secondary transfer roller 18 and the intermediate transfer belts 14, the print medium 53 is held by the secondary transfer roller 18 and the repulsion roller 17. The secondary transfer roller 18 causes the toner image on the intermediate transfer belt 14 to be secondarily transferred to the print medium 53 by the holding pressure and the secondary transfer electric field produced by the voltage supplied to the secondary transfer roller 18.

At an upstream location of the secondary transfer part 50, the registration roller 33 and an upper roller 34 are arranged. At a downstream location of the registration roller 33, a front-end detection sensor 30 is arranged to detect whether the front end of the print medium 53 has reached the location of the sensor 30. The registration roller 33 is rotated by a registration motor 89. The front-end detection sensor 30 and the registration motor 89 are electrically connected to a control device 200. The control device 200 controls a rotating speed of the registration motor 89.

The registration roller 33 is energized in the direction toward the upper roller 34. At least when the print medium 53 passes through the portion between the registration roller 33 and the upper roller, the print medium is held by the registration roller 33 and the upper roller 34.

As described above, the print medium 53 which is transported from the sheet feed tray 22 temporarily stops at the registration roller 33. The control device 200 starts the rotation of the registration motor 89 so that the location of the print medium 53 may match with the location of the toner image on the intermediate transfer belt 14. The registration roller 33 transports the print medium 53 and the print medium 53 is made to enter the secondary transfer roller 18. Alternatively, stopping the print medium 53 by the registration roller 33 may be omitted.

Subsequently, the print medium 53 is in an overlapping condition that it extends from the registration roller 33 to the secondary transfer roller 18, and torque interference between registration roller 33 and the secondary transfer roller 18 may arise as previously described.

To avoid the problem, the control device 200 controls the rotating speed of the registration motor 89 so that the registration roller 33 operates as a follower roller of the secondary transfer roller 18.

The upstream roller at the upstream location of the secondary transfer part 50 is not necessarily the registration roller 33. The control device 200 of this embodiment may be arranged to control an upstream roller for the secondary transfer part 50 in accordance with the design of the image forming device 100 so that the upstream roller operates as a follower roller of the secondary transfer roller 18.

Figure 4:
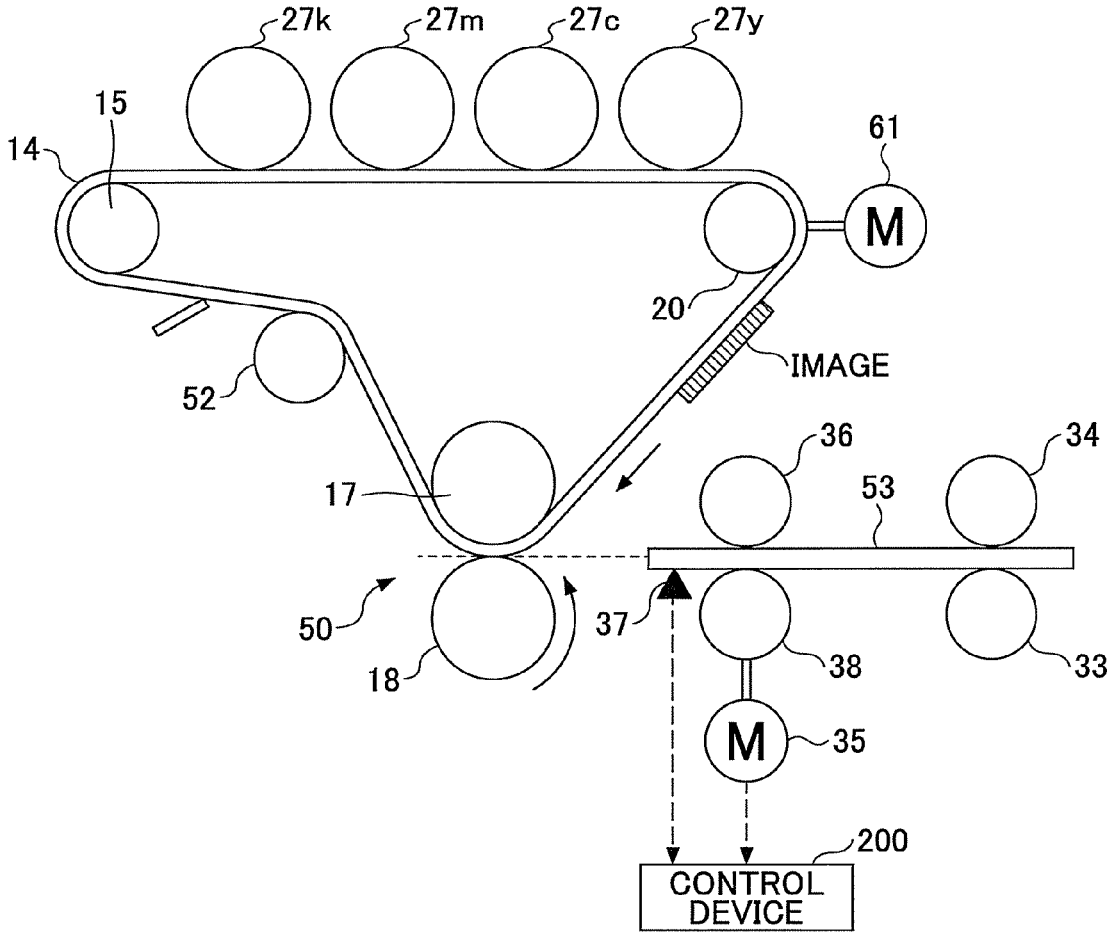
FIG. 4 is a diagram for explaining a structure of a secondary transfer part and a transfer timing roller at an upstream location of the secondary transfer part.

FIG. 4 is a diagram for explaining a structure of a secondary transfer part 50 and a transfer timing roller 38 at an upstream location of the secondary transfer part 50. In FIG. 4, the elements which are essentially the same as corresponding elements in FIG. 3 are designated by the same reference numerals, and a description thereof will be omitted.

As illustrated in FIG. 4, the transfer timing roller 38 is arranged at a downstream location of the registration roller 33 and at an upstream location of the secondary transfer roller 18. At a downstream location of the transfer timing roller 38, a print-medium passage detecting sensor 37 is arranged to detect whether a rear end of a print medium 53 has passed through the transfer timing roller 38.

The control device 200 detects that the rear end of the print medium 53 has passed through the transfer timing roller 38 by using the output of the print-medium passage detecting sensor 37. The control device 200 controls a rotating speed of the transfer timing motor 35 so that the print medium 53 from the print-medium passage detecting sensor 37 arrives at the secondary transfer part 50 in synch with the timing that the toner image formed on the intermediate transfer belt 14 reaches the secondary transfer part 50. In the following, the control of the control device 200 will be described by using the structure of FIG. 4 as an exemplary structure.

FIG. 5 illustrates the hardware composition of the control device 200. The control device 200 includes a motor control unit 81 and a motor driver 83. The motor control unit 81 is connected to a main controller unit 78. The motor driver 83 is connected to the transfer timing motor 35.

The transfer timing roller 38 is connected to a transfer encoder 39 which is provided for feedback control, and the transfer encoder 39 is connected to the motor control unit 81.

The motor driver 83 is a circuit which supplies a motor current based on a speed indication value instructed by the motor control unit 81, to the transfer timing motor 35. For example, the motor driver 83 determines a duty ratio of a PWM (pulse-width modulation) signal based on the speed indication value, and turns on and off the FET (field-effect transistor) connected to each phase of the transfer timing motor 35, in accordance with the PWM signal with the determined duty ratio. The motor driver 83 feedback controls the current value supplied to the transfer timing motor 35 based on the current value detected by a current sensor 82.

A current sensor 85 provided in a motor driver 86 is connected to the motor control unit 81, and the motor control unit 81 detects a driving current which flows into the motor driver 85 of the secondary transfer motor 64, by using the output of the current sensor 85. The motor control unit 81 of the transfer timing motor 35 can detect that the print medium 53 has entered the secondary transfer roller 18, based on the driving current.

The secondary transfer motor 64 is controlled by a control device 300. The method of controlling the secondary transfer motor 64 by the control device is essentially the same as the method of controlling the transfer timing motor 35 by the control device 200, and a description thereof will be omitted.

The main controller unit 78 is a control device which controls the whole image forming device 100. The main controller unit 78 receives operation input by a user and instructs the rotation of each of the secondary transfer motor 64, the transfer timing motor 35, the feed motor, the fixing motor 66, etc.

An operation panel (not illustrated) and a recording medium interface unit 79 are connected to the main controller unit 78. In the operation panel, a liquid crystal display unit and a touch panel are integrally implemented. The operation panel provides a user interface which includes a menu or list indication in combination with an input portion to input a selection of the menu or list indication. The operation panel includes various kinds of hard keys, such as a selection key which switches one of a scanner function, a facsimile function and a copy function to another, a set of ten keys, a start key, a reset key, and a power switch.

The recording medium interface unit 79 is arranged so that a recording medium 80 is detachably attached to the slot of the recording medium interface unit 79. A program according to the present disclosure is stored beforehand in the recording medium 80, and the main controller unit 78 reads out the program from the recording medium 80 through the recording medium interface unit 79 and stores the program in a HDD or a ROM (not illustrated) of the image forming device.

Each of the main controller unit 78 and the control devices 200 and 300 is constituted by a microcomputer including a CPU, a DSP, a RAM, a ROM, an EEPROM, an input/output interface, a flash memory, an ASIC (Application Specific Integrated Circuit), etc. The execution of the program by the CPU and the use of the ICs including the DSP and the ASIC in the control devices 200 and 300 enable the function and the control block of the image forming device 100 (which will be described later) to be carried out.

The motor control units 81 and 84 output a speed indication value (a current command value or a voltage command value) to the motor drivers 83 and 86, respectively. It is assumed that the rotating speed of the transfer timing roller 38 and the rotating speed of the secondary transfer roller 18 in this embodiment are constant. Alternatively, the motor control units 81 and 84 may be arranged to adjust each rotating speed of the transfer timing roller 38 and the secondary transfer roller 18 in response to a request received from the main controller unit 78. For example, if the print medium 53 used is a cardboard sheet, the motor control units 81 and 84 in such alternative embodiment adjust each rotating speed to be a smaller speed value in response to a request received from the main controller unit 78.

Figure 6:
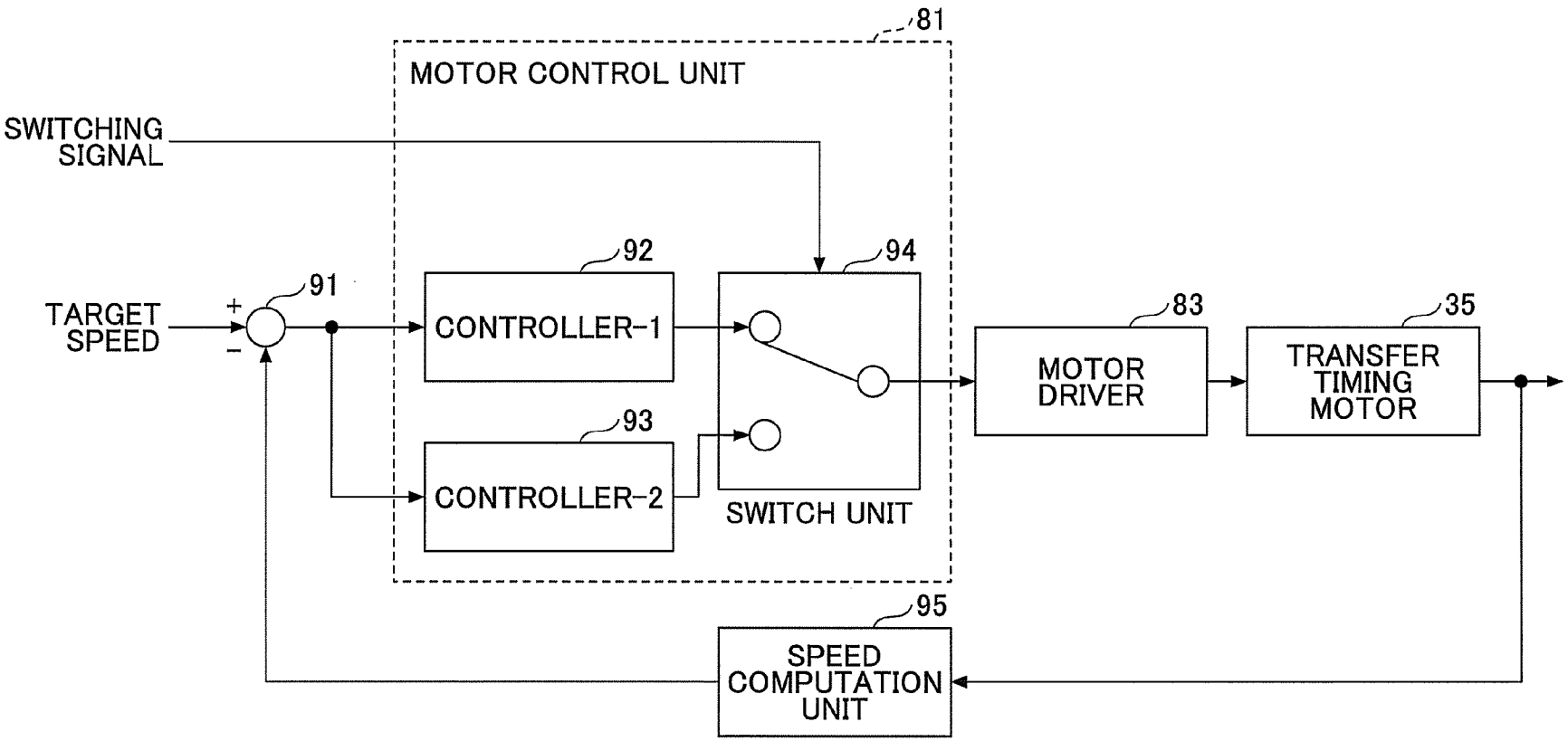
FIG. 6 is a diagram illustrating a control block of a transfer timing roller.

FIG. 6 illustrates a control block of the transfer timing roller 38. Specifically, the feedback loop of a rotating speed of the transfer timing roller 38 is illustrated in FIG. 6.

In the control block of FIG. 6, a comparator 91, a controller 92 (which will be called controller-1), a controller 93 (which will be called controller-2), and a switch unit 94 are arranged to constitute the motor control unit 81 in the control device of FIG. 5.

In the control block of FIG. 6, a comparator 91 outputs a signal indicating a result of comparison between a target rotating speed (target speed) and a rotating speed computed by a speed computation unit 95 based on a detection result of the transfer encoder 39, to each of the controller-1 and the controller-2. The controller-1 performs computation based on the result of comparison from the comparator 91 in accordance with PI (proportion and integration) control, and determines a speed, indication value to be output to the motor driver 83 via the switch unit 94. The controller-2 performs computation based on the result of comparison from the comparator 91 in accordance with PI control, and determines a speed indication value to be output to the motor driver 83 via the switch unit 94.

The target speed, input to each of the controller-1 and the controller-2, is predetermined so that a peripheral speed of the transfer timing roller 38 is substantially equal to a peripheral speed of the secondary transfer roller 18 and a surface speed of the intermediate transfer belt 14.

In the control block of FIG. 6, one of the controller-1 and the controller-2 selectively operates at a same time. When the print medium 53 is transported by the transfer timing roller 38 solely, or when the print medium 53 is not transported by the transfer timing roller 38, the controller-1 controls the rotating speed of the transfer timing roller 38. When the print medium 53 is transported by both the transfer timing roller 38 and the secondary transfer roller 18 in an overlapping manner, the controller-2 controls the rotating speed of the transfer timing roller 38.

Switching one of the controller-1 and the controller-2 to the other is performed by the switch unit 94 in accordance with a switching signal. The switching signal corresponds to a signal which indicates that the print medium 53 has entered the secondary transfer roller 18. When the controller-1 and the controller-2 are implemented by software, the motor control unit 81 detects that the print medium 53 has entered the secondary transfer roller 18, and turns off the controller-1 and turns on the controller-2.

The motor control unit 81 detects that the print medium 53 as a whole is ejected from the transfer timing roller 38, and turns off the controller-2 and turns on the controller-1.

Each of the controller-1 and the controller-2 performs multiplication of a predetermined gain to a speed error, performs a predetermined filtering process, and outputs the resulting signal to the motor driver 83 as the speed indication value.

The controller-1 and the controller-2 may be arranged by using a compensation method selected from among a classical control method (such as, PI, PID, phase advance, phase lag), a state feedback method based on a contemporary control method which feeds back a quantity of state of the transfer timing roller 38, and a robust control method.

The motor driver 83 is a current control driver which outputs a motor driving current in accordance with a speed indication value (or a voltage control driver which outputs a motor voltage in accordance with a voltage command value). The transfer timing motor 35 is driven by the motor driving current output by the motor driver 83 according to the speed indication value. The driving force of the transfer timing motor 35 is transmitted through a transmission mechanism to the transfer timing roller 38 so that the transfer timing roller 38 is rotated. One of a DC motor (of brush type or of brushless type), an AC servo-motor, and a stepping motor may be used as the transfer timing motor 35.

A rotating speed of the transfer timing roller 38 is detected by the transfer encoder 39. The detected rotating speed from the transfer encoder 39 is input to the speed computation unit 95. The speed computation unit 95 converts the result of detection from the transfer encoder 39 into a rotating speed for comparison with the target speed, and feeds the rotating speed back to the comparator 91. The method of speed computation used for the speed computation unit 95 may be either a method which uses a difference of a count value of encoder pulses, or a periodic counter method which measures an edge of an encoder pulse using a reference clock.

Alternatively, the speed computation unit 95 may be implemented so that the speed computation unit 95 is included in the transfer encoder 39 of FIG. 5. Alternatively, the speed computation unit 95 may be implemented so that the speed computation unit 95 is included in the motor control unit 81.

Next, speed compensation in this embodiment will be described. In a case of a software servo which performs speed compensation by software, switching one of the controller-1 and the controller-2 to the other is performed by switching one of the two different formulas for computing the current command value to the other, or by changing the parameters in the same formula for computing the current command value.

For example, when the software servo is implemented by a PI (proportion and integration) filter (which is used for a motor driving system) according to the classical control method, the formula for computing the current command value is represented by the following formula (1).

$$y(n) = kp \times \left(1 + \frac{z}{z-1} \times ts \times ki\right) \times u(n) \tag{1}$$

In the formula (1), u(n) denotes a speed error, y(n) denotes a speed indication value, and ts denotes a sampling time. The sampling time ts is a period at intervals of which the rotating speed is detected by the transfer encoder 39, or a period at intervals of which the speed indication value is computed. If the proportionality constant kp and the integration constant ki (which are the parameters indicating the gain) are changed, one of the controller-1 and the controller-2 is switched to the other.

The proportionality constant kp and the integration constant ki of the controller-1 are predetermined such that, when the print medium 53 is transported by the transfer timing roller 38 only, an appropriate speed compensation may be obtained.

Figure 7:
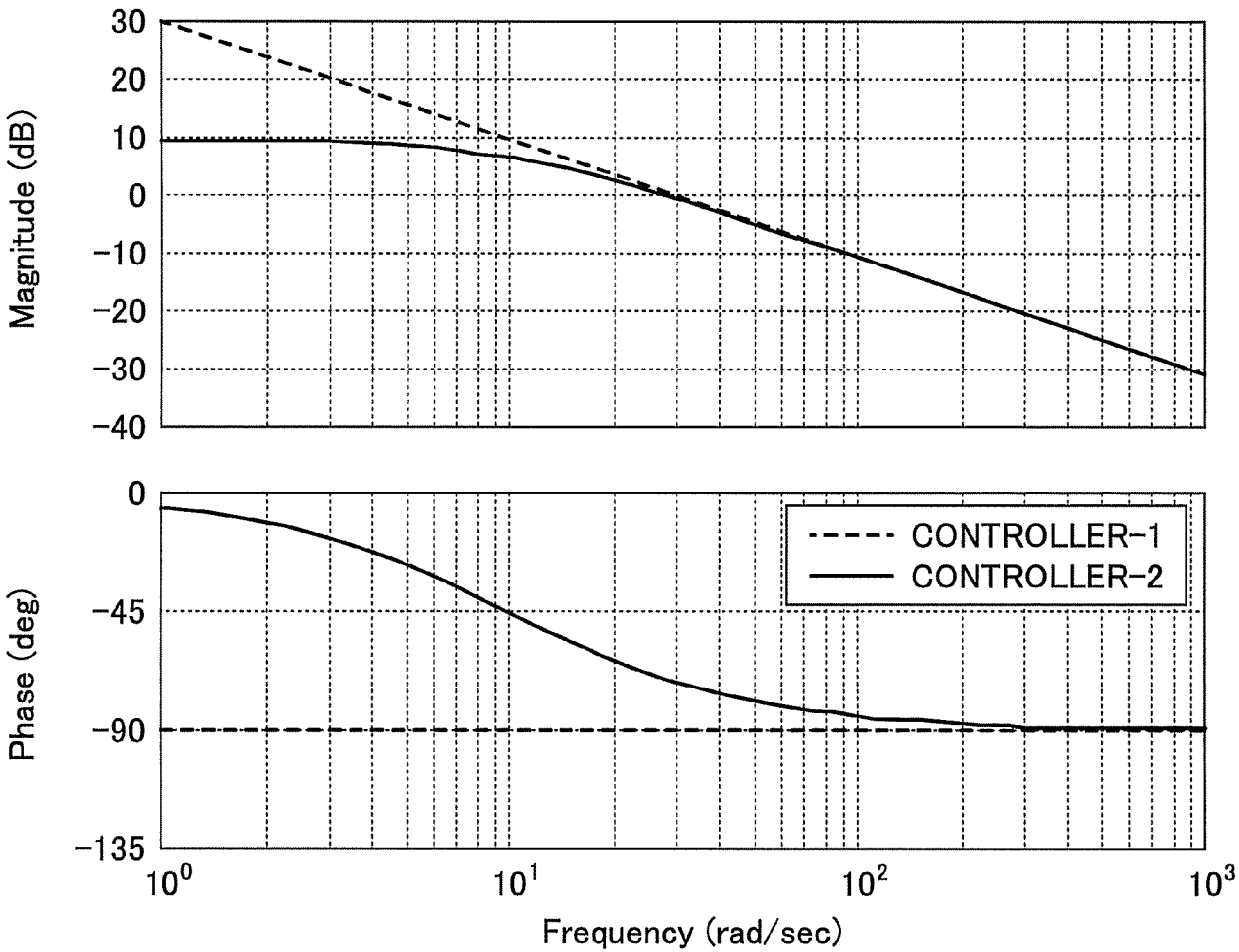
FIG. 7 is a diagram illustrating an example of a Bode diagram.

Operation of the image forming device when only the integration constant ki is set to "0" will be described with reference to a Bode diagram of FIG. 7. In FIG. 7, the dotted lines indicate the gain curve and the phase-angle curve of the controller-1, and the solid lines indicate the gain curve and the phase-angle curve of the controller-2, respectively.

As indicated by the gain curve of the controller-2, if the integration multiplier ki in the formula (1) is set to zero, the integration characteristic is set to zero so that the gain in a low frequency region is lowered to be smaller than the gain of the controller-1. Specifically, the response sensibility in the low frequency region is lowered. The gain in the low frequency region indicates the amount of compensation of the rotating speed to fluctuation of the speed error which is changed slowly. Especially, the gain in the low frequency region indicates the amount of compensation to the DC component of the speed error. Therefore, the gain curve of the controller-2 indicates that lowering of the gain in the low frequency region and compensation of the DC component are lost.

Immediately after the print medium 53 enters the secondary transfer roller 18, the rotating speed of the transfer timing roller 38 falls because of the entering load. Setting the integration constant ki to zero to perform only the proportional control indicates that a steady speed error (a deviation of the rotating speed from the target speed) arises. In the proportional control, when a controlled amount approaches the target, the controlled amount is stabilized in the condition near the target. Even when the integration constant ki is set to zero, the transfer timing roller 38 supports the transporting load of the print medium 53 according to the proportionality constant kp. However, the transfer timing roller 38 does not act to push the secondary transfer roller 18, but gives slight tension to the print medium 53. Namely, the transfer timing roller 38 functions as the follower roller of the secondary transfer roller 18.

On the other hand, as is apparent from the Bode diagram of FIG. 7, the gain curve of the controller-2 in a high frequency region is equivalent to the gain curve of the controller-1, and the motor control unit 81 can follow rapid speed fluctuation and control the rotating speed of the transfer timing motor 35.

Figure 8:
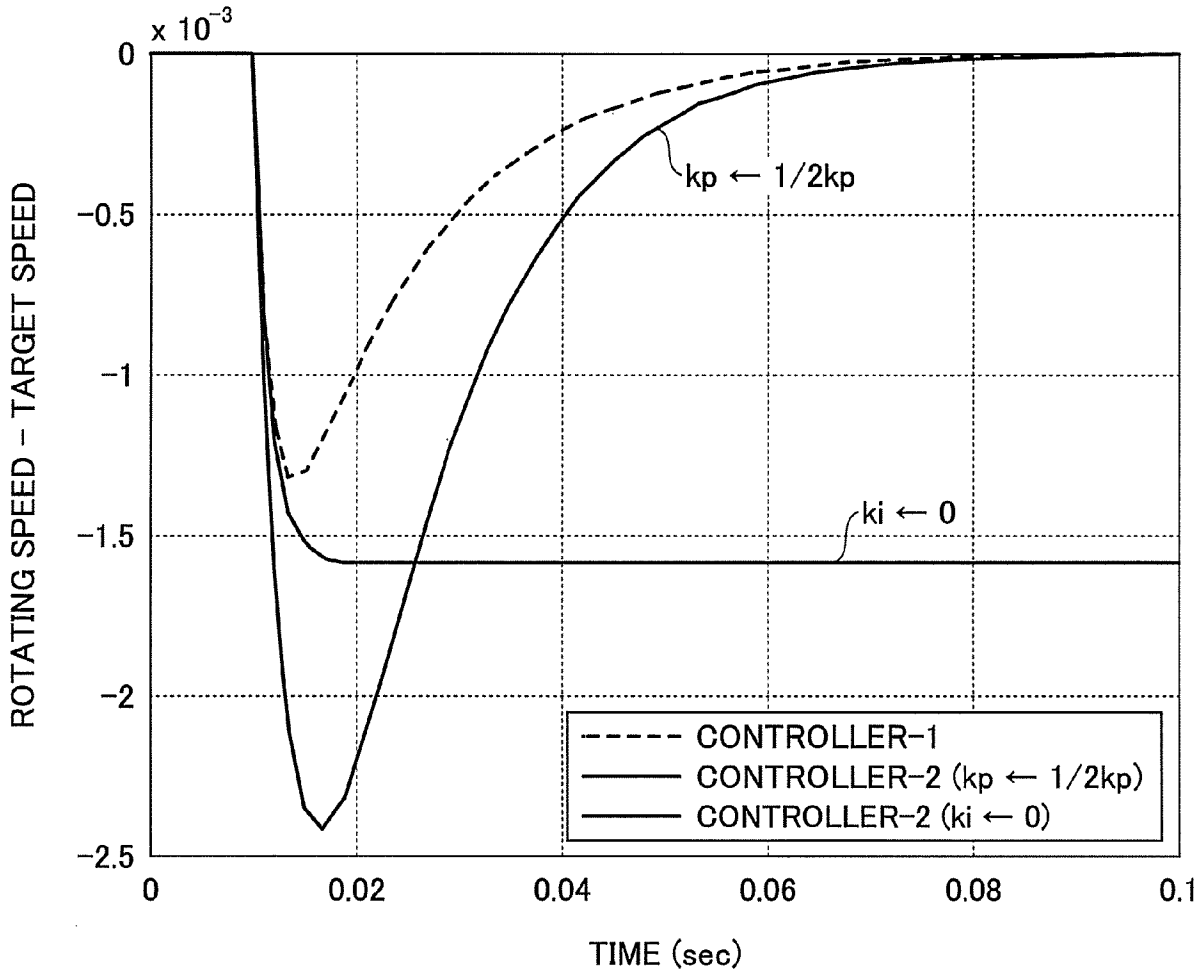
FIG. 8 is a diagram illustrating an example of a relationship between time and speed error.

Next, FIG. 8 is a diagram for explaining the relationship between time and speed error.

Because the vertical axis in FIG. 8 denotes a speed error of "rotating speed"–"target speed", what is meant by the speed error which has a negative value is that the rotating speed is smaller than the target speed. The unit of the speed error may be optional. For example, the unit of the speed error may be expressed by [rad/sec] or [%].

As is apparent from FIG. 8, the print medium 53 has entered the secondary transfer roller 18 at a time of 0.01 seconds. In the controller-1 (indicated by the dotted line in FIG. 8), the rotating speed of the transfer timing roller 38 rapidly falls because of the entering load, and the speed error approaches 0 with time.

In the controller-2 (indicated by the solid line in FIG. 8), if the integration constant ki is set to zero, the controller-2 can respond to speed fluctuations in a high frequency region similar to the controller-1, and the rotating speed of the transfer timing roller 38 rapidly falls because of the entering load, but the speed error remains unchanged with time.

Because the speed error has a negative value, it can be understood that the rotating speed of the transfer timing roller 38 is smaller than that of the secondary transfer roller 18, i.e., slight tension in the print medium 53 arises. Thus, the transfer timing roller 38 does not act to compress the print medium 53 in the direction toward the secondary transfer roller 18. It is possible to prevent the driving torque of the secondary transfer roller 18 from being nearly zero or a negative torque (braking), and it is possible to prevent the operating condition of the control system from becoming unstable.

Accordingly, the control which sets the integration constant ki to zero is equivalent to the control which lowers the response sensibility to the speed control in a predetermined low-frequency range.

In this embodiment, the integration constant ki of the controller-2 is set to zero. Alternatively, the integration constant ki of the controller-2 may be changed to a positive value that is sufficiently smaller than the integration constant ki of the controller-1. For example, the integration constant ki of the controller-2 may be changed to 1/10 of the integration constant ki of the controller-1, which results in the same effectiveness as in this embodiment. Also, when the integration constant ki of the controller-2 is changed to ½ of the integration constant ki of the controller-1, a certain amount of effectiveness can be obtained. Thus, the integration constant ki of the controller-2 can be suitably changed to a value in a range of zero and ½ of the integration constant ki of the controller-1.

Figure 9:
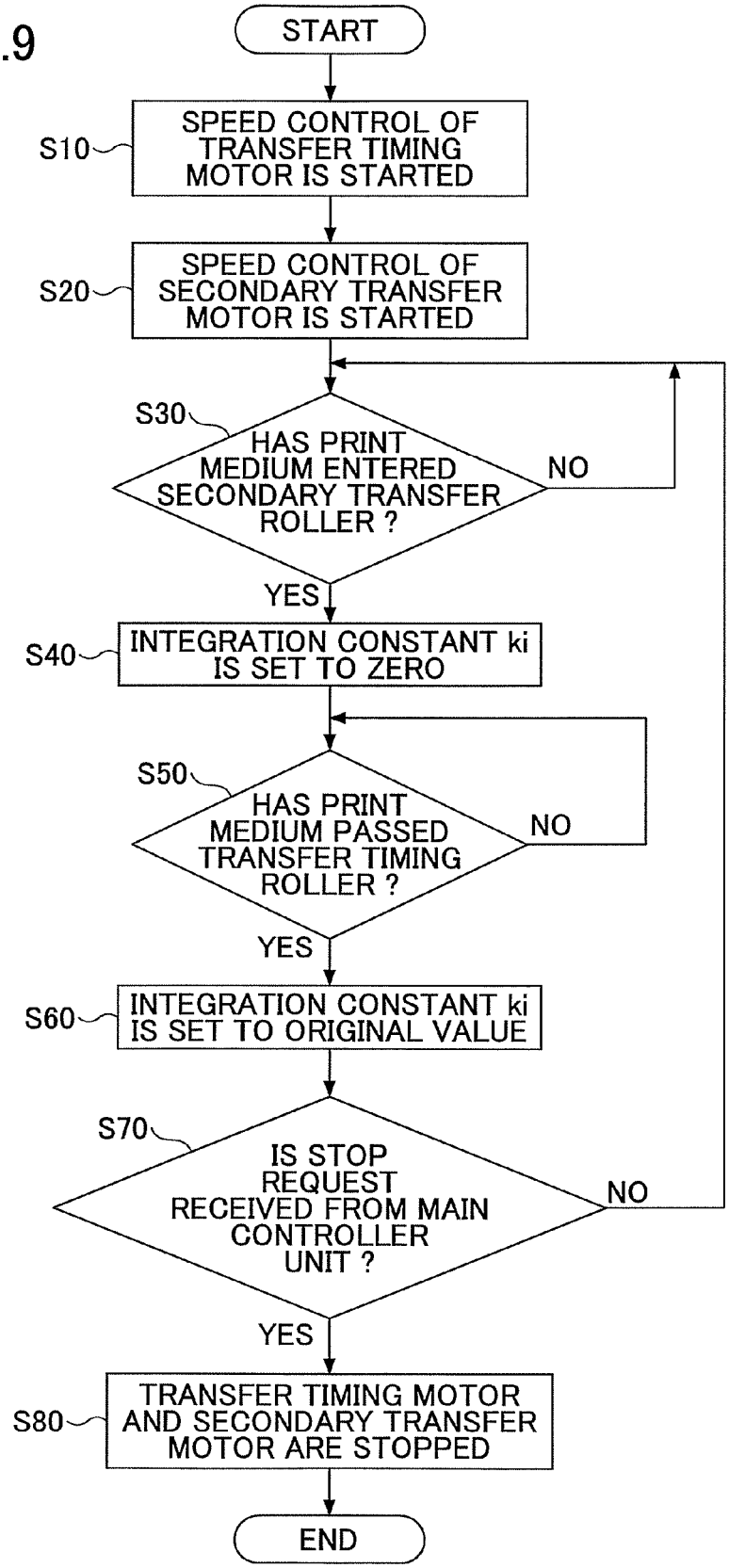
FIG. 9 is a flowchart for explaining a procedure in which a motor control unit controls a rotating speed of a transfer timing roller.

FIG. 9 is a flowchart for explaining a procedure in which the motor control unit 81 controls a rotating speed of the transfer timing roller 38.

For example, the procedure of FIG. 9 is started when the image forming device 100 starts printing of a print medium 53.

The main controller unit 78 transmits a driving command to the motor control unit 81. At this time, a target speed of the transfer timing roller 38 may be determined by the main controller unit 78. The target speed is determined so that a peripheral speed of the transfer timing motor 35 and a peripheral speed of the secondary transfer motor 64 are the same.

When the driving command is received, the motor control unit 81 starts control of a rotating speed of the transfer timing roller 38 (S10).

Subsequently, the motor control unit 84 starts control of a rotating speed of the secondary transfer motor 64 (S20).

Subsequently, the motor control unit 81 determines whether the print medium 53 has entered the secondary transfer roller 18 (S30). The method of determining whether the print medium 53 has entered the secondary transfer roller 18, used at this time, may be one of the following methods:

(1) the timing at which the print medium 53 from the transfer timing roller 38 reaches the secondary transfer roller 18 is estimated;

(2) the timing at which the print medium 53 from the print-medium passage detecting sensor 37 reaches the secondary transfer roller 18 is estimated;

(3) the driving current in the motor driver 86 of the secondary transfer motor 64 detected by the current sensor 85 is monitored.

The case in which the determining method of (1) above is used will be described. Because the transfer timing roller 38 is a roller arranged for matching the timing at which the print medium 53 enters the secondary transfer roller 18, with the location of a toner image, the motor control unit 81 determines the time driving of the transfer timing roller 38 is started. When the driving current detected by the current sensor 82 is changed, the motor control unit 81 is also able to detect that the print medium 53 has reached the transfer timing roller 38, and detect that the print medium 53 has started passing the transfer timing roller 38. It is assumed that a transporting speed of the print medium 53 and a distance between the transfer timing roller 38 and the secondary transfer roller 18 are known. Therefore, the motor control unit 81 compares the elapsed time after the time the print medium 53 started passing the transfer timing roller 38, with a predetermined reference time, and the motor control unit 81 determines that the print medium 53 has entered the secondary transfer roller 18, based on a result of the comparison of the elapsed time and the reference time.

Moreover, it is assumed that a distance between the print-medium passage detecting sensor 37 and the secondary transfer roller 18 is known. Hence, the determining method of (2) above is essentially the same as the determining method of (1) above, and a description thereof will be omitted.

The case in which the determining method of (3) above is used will be described. The load torque acting on the secondary transfer motor 64 when the print medium 53 is being transported is larger than that when the print medium 53 is not transported. After the print medium 53 has passed the transfer timing roller 38, the motor control unit 81 monitors the driving current of the secondary transfer roller 18. For example, if a change of the current value is larger than a predetermined value, the motor control unit 81 determines that the print medium 53 has entered the secondary transfer roller 18.

One of the methods of (1)-(3) above may be used. Alternatively, it may be determined that the print medium 53 has entered the secondary transfer roller 18 as follows. Specifically, all of the methods of (1)-(3) above are used, and when one or more determining methods determine that the print medium 53 has entered the secondary transfer roller 18.

When it is determined in step S30 that the print medium 53 has entered the secondary transfer roller 18, the motor control unit 81 switches off the controller-1 and switches on the controller-2 (S40). Specifically, the motor control unit 81 sets the integration constant ki to zero. This control enables the transfer timing roller 38 to function as a follower roller of the secondary transfer roller 18.

Subsequently, the motor control unit 81 determines whether the print medium 53 has passed the transfer timing roller 38 (S50). The method of determining whether the print medium 53 has passed the transfer timing roller 38, used at this time, may be one of the following methods:

(4) the timing at which the whole print medium 53 passes the transfer timing roller 38 is estimated;

(5) the condition in which the presence of the print medium 53 is not detected by the print-medium passage detecting sensor 37 is detected: and (6) the driving current in the motor driver 81 of the transfer timing motor 35, detected by the current sensor 82, is monitored.

The determining method of (4) above is essentially the same as the determining method of (1) or (2) above, and the motor control unit 81 can determine that the whole print medium 53 has passed the transfer timing roller 38, based on the transporting speed and the sheet size.

In the case of the determining method of (5) above, when the presence of the print medium 53 is not detected by the print-medium passage detecting sensor 37, the motor control unit 81 can certainly determine that the whole print medium 53 has passed the transfer timing roller 38.

In the case of the determining method of (6) above, when a change of the driving current is larger than a predetermined value, the motor control unit 81 determines that the whole print medium 53 has passed the transfer timing roller 38.

The switching on of the controller-1 and the switching off of the controller-2 may be performed until the time a following print medium 53 reaches the transfer timing roller 38.

When it is determined in step S50 that the print medium 53 has passed the transfer timing roller 38, the motor control unit 81 switches off the controller-2 and switches on the controller-1 (S60). Specifically, the motor control unit 81 resets the integration constant ki to the original value.

Subsequently, each of the motor control units 81 and 84 determines whether a stop request of the transfer timing roller 38 and the secondary transfer roller 18 from the main controller unit 78 is received (S70). For example, reception of a stop request output by the main controller unit 78 means that the printing of the print medium 53 is completed, or means that a paper jam takes place.

When it is determined in step S70 that a stop request of the transfer timing roller 38 and the secondary transfer roller 18 from the main controller unit 78 is not received, the steps S30 to S70 are repeatedly performed by the motor control units 81 and 84. Specifically, printing of a second or subsequent print medium 53 is repeated.

When it is determined in step S70 that a stop request of the transfer timing roller 38 and the secondary transfer roller 18 from the main controller unit 78 is received, each of the motor control units 81 and 84 terminates the procedure (S80). Hence, the transfer timing roller 38 and the secondary transfer roller 18 are stopped.

As described above, when the print medium 53 in an overlapping condition is transported by both the transfer timing roller and the secondary transfer roller 18 in the image forming device 100 of this embodiment, the integration constant ki in the PI control system is set to zero, and it is possible to prevent the print medium 53 from being compressed to the direction toward the secondary transfer roller 18 by the transfer timing roller 38. Therefore, it is possible to prevent the deterioration of image quality or the color deviation from occurring in the secondary transfer part 50 due to the torque interference.

Because the gain is lowered only in a low-frequency region, the response sensibility to the speed fluctuation can be lowered only in the low-frequency region.

Embodiment 2

In the Embodiment 1, the integration constant ki in the formula (1) is set to zero. In the image forming device 100 of this embodiment, only the proportionality constant kp is lowered or both the proportionality constant kp and the integration constant ki are lowered to values that are smaller than those corresponding values of the controller-1. As will be described below, the image forming device of this embodiment is capable of preventing the torque interference between the transfer timing roller 38 and the secondary transfer roller 18 from being excessively large.

Figure 10:
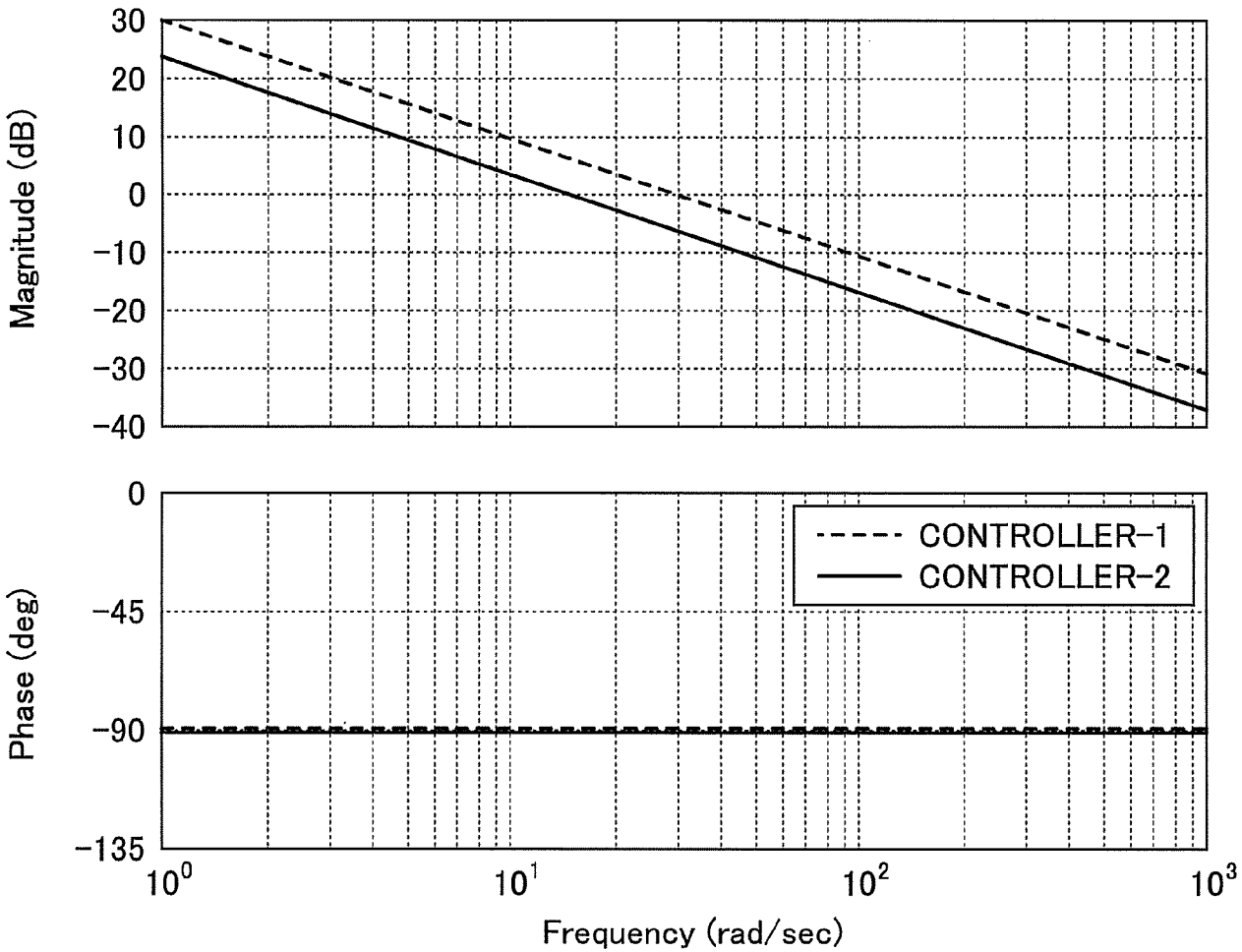
FIG. 10 is a diagram illustrating an example of a Bode diagram in which a proportionality constant kp is set to half (½) of that of a controller-1.

FIG. 10 illustrates an example of a Bode diagram in which the proportionality constant kp is set to half (½) of that of the controller-1. In FIG. 10, the gain curve and the phase-angle curve of the controller-1 are indicated by the dotted line, and the gain curve and the phase-angle curve of the controller-2 are indicated by the solid line.

Changing only the proportionality constant kp to a small value or changing both the proportionality constant kp and the integration constant ki to small values simultaneously makes it possible to lower the response frequency of a drive system. As illustrated in FIG. 10, the gain curve of the controller-2 is smaller than the gain curve of the controller-1 and has an inclination of −20 dB/decade which is known as an inclination of an integrator. The response frequency of the controller-1 is 30 rad/sec and the response frequency of the controller-2 is 15 rad/sec. Therefore, it can be understood that the response frequency is made smaller than before in accordance with a change of the proportionality constant kp. The reduction of the response frequency means the falling of the gain, which shows that the compensation for the fluctuation (AC component) of the rotating speed of the transfer timing roller 38 is made small. In other words, the response sensibility falls in all the frequency regions. Therefore, the influence of the torque of the transfer timing roller 38 on the secondary transfer roller 18 can be reduced. It is possible to improve the transient response of the control system when the print medium 53 has entered the secondary transfer roller 18.

With reference to FIG. 8, operation of the image forming device of this embodiment will be described. The print medium 53 has entered the secondary transfer roller 18 at a time of 0.01 seconds. In the controller-2 (the proportionality constant kp=½), the speed fluctuation when the rotating speed of the transfer timing roller 38 rapidly falls because of the entering load is larger than that of the controller-1. This means that the influence of the transfer timing roller 38 on the secondary transfer roller 18 became small compared to the rapid speed fluctuation. It can be understood that making the gain of the controller-2 smaller than the gain of the controller-1 enables the torque interference between the secondary transfer roller 18 and the transfer timing roller 38 to be reduced.

Because the gain expresses the magnitude of the speed compensation, the reduction of the gain means that the influence of the torque of the transfer timing roller 38 on the secondary transfer roller 18 is made small irrespective of the frequency region. As illustrated in FIG. 8, there is a time lag until the rotating speed of the transfer timing roller 38 reaches the target speed, and the rotating speed of the transfer timing roller 38 is smaller than that of the secondary transfer roller 18 during this period. The tension in the print medium by the transfer timing roller 38 at this time is smaller than that of the Embodiment 1, and the transfer timing roller 38 operates as a follower roller of the secondary transfer roller 18.

In this embodiment, the proportionality constant kp of the controller-2 is set to ½ of that of the controller-1. However, this is not limited to this embodiment. Alternatively, the proportionality constant kp of the controller-2 may be set to ¾ of that of the controller-1 or set to a value in a range of ⅓ to ⅕ of that of the controller-1. How the proportionality constant kp of the controller-2 is set with respect to that of the controller-1 may be suitably determined depending on the design.

Figure 11:
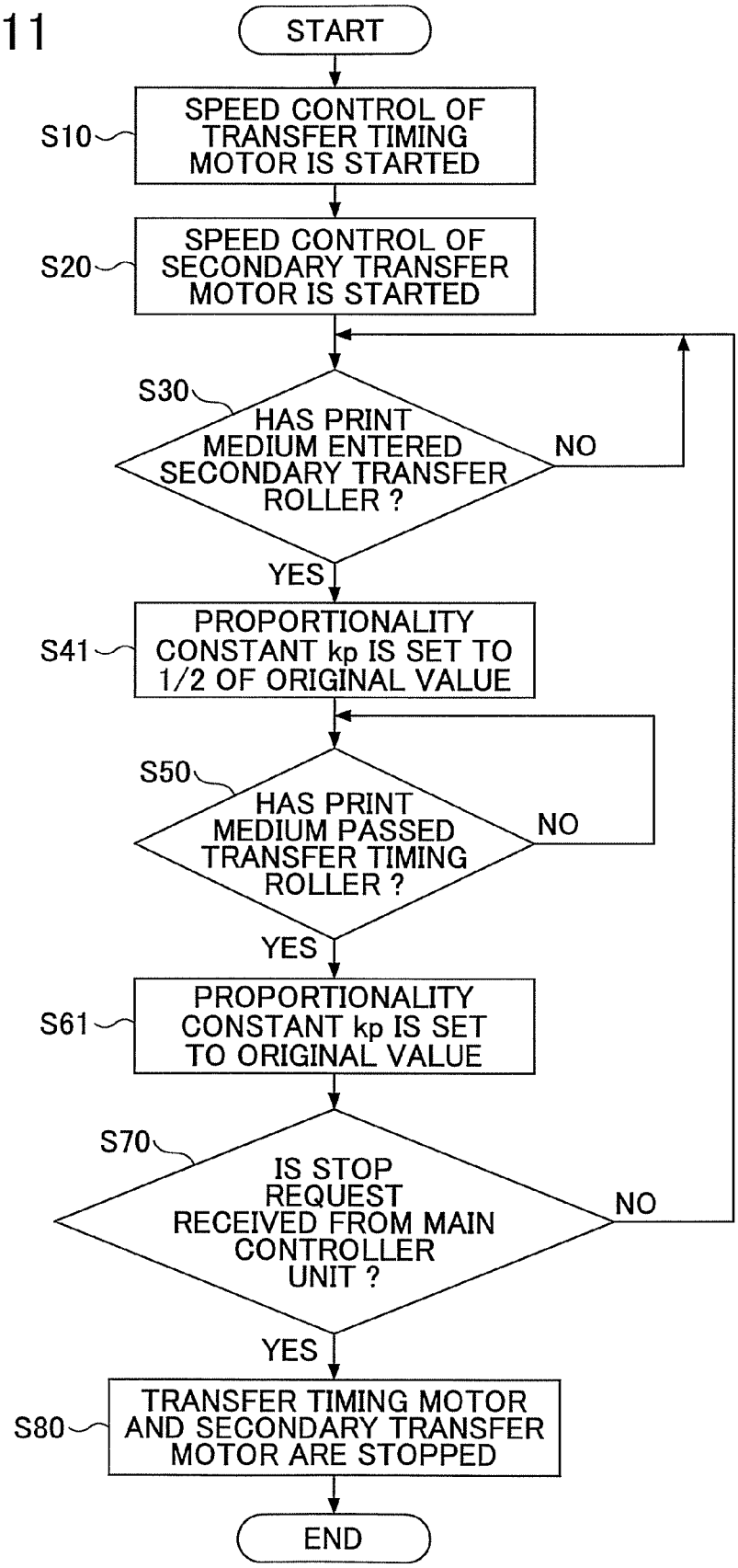
FIG. 11 is a flowchart for explaining a procedure in which a motor control unit controls a rotating speed of a transfer timing roller.

Next, FIG. 11 is a flowchart for explaining a procedure in which the motor control unit 81 controls a rotating speed of the transfer timing roller 38.

For example, the procedure of FIG. 11 is started when the image forming device 100 starts printing of a print medium 53.

In the flowchart of FIG. 11, a description of the steps which are the same as corresponding steps in FIG. 9 will be omitted. In the flowchart of FIG. 11, only the procedure which corresponds to the steps S40 and S60 in FIG. 9 differs, which will be described.

Specifically, when it is determined in step S30 that the print medium 53 has entered the secondary transfer roller 18, the motor control unit 81 switches the controller-1 to the controller-2 (S41). Namely, the motor control unit 81 sets the proportionality constant kp to one half (½) of the original value of the proportionality constant. Thereby, the transfer timing roller 38 is made to operate as a follower roller of the secondary transfer roller 18.

When it is determined in step S50 that the print medium 53 has passed the transfer timing roller 38, the motor control unit 81 switches the controller-2 to the controller-1 (S61). Namely, the motor control unit 81 resets the proportionality constant kp to the original value of the proportionality constant.

As described above, the image forming device 100 of this embodiment is arranged so that, when the print medium 53 is transported in an overlapping manner by both the transfer timing roller 38 and the secondary transfer roller 18, the proportionality constant kp is set to a value smaller than the original value. Therefore, the influence of the torque of the transfer timing roller 38 in the direction toward the secondary transfer roller 18 can be reduced. Hence, it is possible to prevent the deterioration of image quality or the color deviation from occurring in the secondary transfer part 50.

Alternatively, the Embodiment 2 and the Embodiment 1 may be combined so that the proportionality constant kp is set to a value smaller than the value of the controller-1 and the integration constant ki is set to zero. In such alternative embodiment, the influence of the torque of the transfer timing roller 38 in the direction toward the secondary transfer roller 18 can be reduced and the compression in the print medium 53 by the transfer timing roller 38 in the direction toward the secondary transfer roller 18 can be eliminated.

The values of the proportionality constant kp and the integration constant ki in the controller-2 to be set in this case are not limited to kp=½ and ki=0. Alternatively, they may be appropriately set up as the proportionality constant kp=¾-⅕ and the integration constant ki=0-1/10, depending on the design.

In this embodiment, the gain is lowered in the whole frequency region of the control system and the response sensibility can be lowered as a whole.

Embodiment 3

In the Embodiment 1 or 2, when the print medium 53 is transported in an overlapping condition by both the transfer timing roller 38 and the secondary transfer roller 18, the motor control unit 81 switches the controller-1 to the controller-2. In this embodiment, the image forming device 100 is arranged to supply a fixed torque command value to the motor driver 83, instead of using the controller-2.

Figure 12:
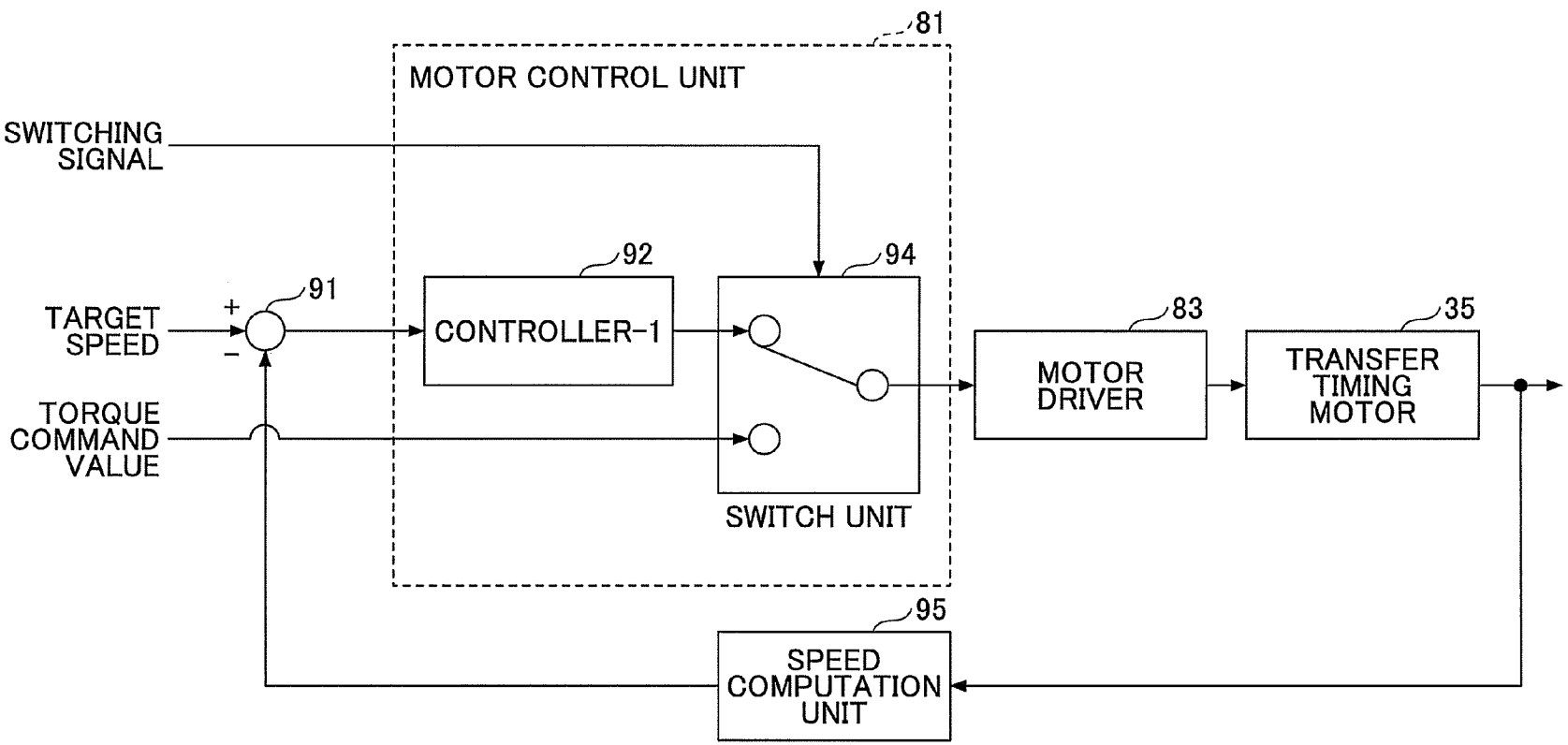
FIG. 12 is a block diagram illustrating the composition of a motor control unit.

FIG. 12 illustrates the control block of the motor control unit 81 of this embodiment. In FIG. 12, the elements which are essentially the same as corresponding elements in FIG. 6 are designated by the same reference numerals, and a description thereof will be omitted.

In the control block of the motor control unit 81 of FIG. 12, the motor driver 83 is constituted by a current control driver. The controller-1 is the same as the controller-1 in the Embodiments 1 and 2. Similar to the Embodiments 1 and 2, the motor control unit 81 of this embodiment switches the controller-1 to the torque command value in accordance with a switching signal. This switching signal corresponds to a signal indicating that the print medium 53 has entered the secondary transfer roller 18. When the controller-1 is implemented by software, the motor control unit 81 detects that the print medium 53 has entered the secondary transfer roller 18, stops the computation of the current command value based on the controller-1, and switches the controller-1 to the control mode in which the torque command value is input to the motor driver 83.

Moreover, the motor control unit 81 detects that the print medium 53 is fully ejected from the transfer timing roller 38, and switches the control mode in which the torque command value is input to the motor driver 83 back to the determination of the current command value based on the controller-1.

When the print medium 53 is transported in an overlapping condition by both the transfer timing roller 38 and the secondary transfer motor 64, the motor control unit 81 converts the torque command value into a current command value and inputs the current command value to the motor driver 83. The motor driver 83 supplies a current according to the received current command value to the transfer timing motor 35. The transfer timing motor 35 is driven by the current command value according to the torque command value. The transfer timing motor 35 generates a torque according to the torque command value.

The torque command value is determined such that the secondary transfer motor 64 does not generate a negative torque due to the transfer timing roller 38 pushing the secondary transfer roller 18, or the motor driver 83 of the secondary transfer motor 64 does not operate in a nonlinear region. Briefly, the torque command value is determined as being a value smaller than the load torque generated by the secondary transfer roller 18 when the print medium 53 is transported by both the secondary transfer roller 18 and the transfer timing roller 38. Thereby, the transfer timing roller 38 does not push the secondary transfer roller 18. The transfer timing roller 38 assists the load torque at which the secondary transfer roller 18 transports the print medium 53 by the driving torque of the torque command value. When the print medium 53 is transported by both the secondary transfer roller 18 and the transfer timing roller 38, the tension according to a difference between the load torque of the secondary transfer motor 64 and the torque command value of the transfer timing motor 35 is exerted on the print medium 53.

Because the load torque of the secondary transfer motor 64 varies depending on the linear speed (transporting speed) and the kind of the print medium 53, a set of torque command values associated with the linear speeds and the kinds of the print medium 53 respectively are stored beforehand in the ROM or HDD of the motor control unit 81. By storing the table of such torque command values in the ROM or HDD, the motor control unit 81 is configured to select and read a torque command value from the table in accordance with the linear speed and the kind of the print medium 53 which are received from the main controller unit 78.

In this embodiment, a fixed torque command value is supplied. Alternatively, the motor control unit 81 may be arranged to adjust a torque command value. In the alternative embodiment, the motor control unit 81 of the transfer timing roller 38 measures a load current or a load torque of the secondary transfer roller 18, and determines a torque command value to be supplied to the transfer timing roller 38 based on the measured load current or torque. The torque command value determined by the motor control unit 81 is slightly smaller than a load torque corresponding to the measured load current of the secondary transfer roller 18 or the measured load torque of the secondary transfer roller 18 (for example, a value in a range of 90% to 98% of the load torque).

Alternatively, the motor control unit 81 may be arranged to include an observer, instead of directly measuring the load current or load torque of the secondary transfer roller 18. The observer is provided to estimate a load current or a load torque of the secondary transfer roller 18. If a state x cannot be directly measured, the observer serves as a state estimator which estimates the state x based on an output g and an input f. When the load current or the load torque is estimated, it is preferred that a low pass filter is arranged between the output of the observer and the input of the motor control unit 81. This helps the motor control unit 81 to be robust to noise.

As described above, it is possible to prevent the transfer timing roller 38 from pushing the secondary transfer roller 18, and the control device 200 of this embodiment can prevent the deterioration of image quality or the color deviation. It is possible to prevent the driving torque of the secondary transfer roller 18 from approaching zero or becoming a negative torque (braking), and it is possible to avoid the unstable condition of the control system.

In this embodiment (and the following embodiments and modifications), the control system does not use a feedback loop. The response sensibility in all the frequency regions of the control system of the control device 200 of this embodiment becomes zero. Namely, the response sensibility of the control device 200 when the print medium 53 is transported by both the secondary transfer roller 18 and the transfer timing roller 38 is lower than the response sensibility when the print medium 53 is transported by the secondary transfer roller 18 solely.

Figure 13:
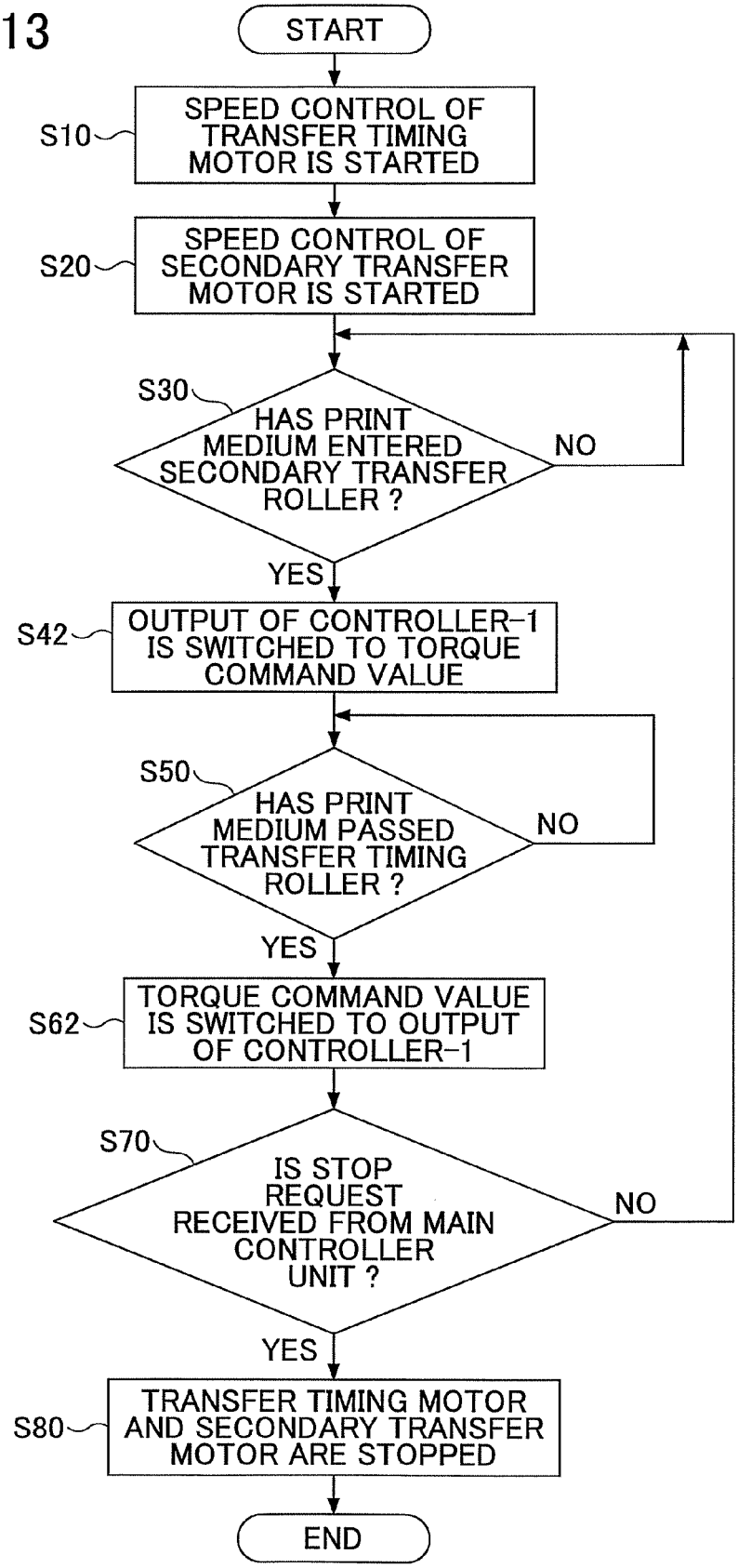
FIG. 13 is a flowchart for explaining a procedure in which a motor control unit controls a rotating speed of a transfer timing roller.

Next, FIG. 13 is a flowchart for explaining a procedure in which the motor control unit 81 controls a rotating speed of the transfer timing roller 38.

For example, the procedure of FIG. 13 is started when the image forming device 100 starts printing of a print medium 53.

In the flowchart of FIG. 13, a description of the steps which are the same as corresponding steps in FIG. 9 will be omitted. In the flowchart of FIG. 13, only the procedure of steps S42 and S62 differs from the procedure of the corresponding steps S40 and S60 in FIG. 9, which will be described.

Specifically, when it is determined in step S30 that the print medium 53 has entered the secondary transfer roller 18, the motor control unit 81 switches the computation of a current command value based on the controller-1 to the control mode in which the fixed torque command value is supplied to the motor driver 83 (S42). Thereby, the transfer timing roller 38 is made to operate as a follower roller of the secondary transfer roller 18.

When it is determined in step S50 that the print medium 53 has passed the transfer timing roller 38, the motor control unit 81 switches the control mode in which the torque command value is supplied to the motor driver 83, to the computation of the current command value based on the controller-1 (S62). The procedure of subsequent steps in this embodiment is the same as that of FIG. 9, and a description thereof will be omitted.

In this embodiment, as illustrated in FIG. 12, the torque command value is converted into a current command value by the motor driver 83 and the current command value is supplied to the transfer timing motor 35. It is the prerequisite for this composition that the motor driver 83 is constituted by a current control driver. Because the current control driver must have a control loop which detects a current and feeds back the current, the current control driver requires a current detection sensor, a processor unit, etc., and therefore the cost increases. In particular, when a 3-phase brush-less motor is used as the transfer timing motor 35, at least two sensors must be included in the current control driver and therefore the control logic becomes complicated.

Figure 14:
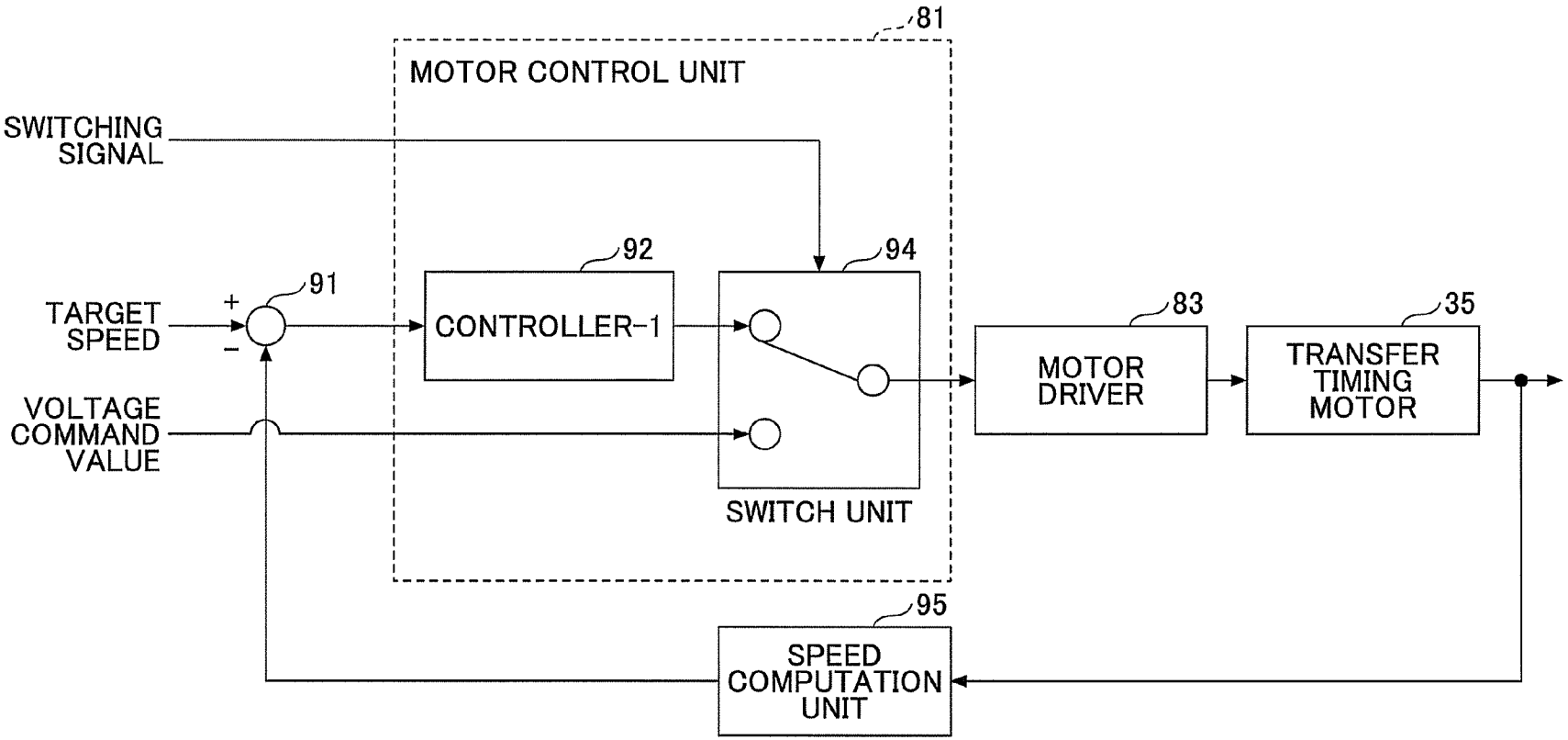
FIG. 14 is a diagram illustrating the composition of a motor control unit.

To eliminate the problem, the motor driver 83 may be implemented as a voltage control driver, instead of the current control driver. FIG. 14 illustrates the control block of a motor control unit 81 of this embodiment. In FIG. 14, the elements which are essentially the same as corresponding elements in FIG. 12 are designated by the same reference numerals, and a description thereof will be omitted. The motor driver 83 of FIG. 14 is constituted by a voltage control driver.

The controller-1 of this embodiment is the same as the controller-1 of the Embodiment 1 or 2. The computation and the switching of the input current command value by the controller-1 are performed according to a switching signal similar to the Embodiment 1 or 2. The motor control unit 81 detects that the print medium 53 has entered the secondary transfer roller 18, stops the computation of the voltage command value by the controller-1, and switches the controller-1 to the control mode in which the voltage command value is input to the motor driver 83.

Moreover, the motor control unit 81 detects that the print medium 53 is fully ejected from the transfer timing roller 38, and switches the control mode in which the voltage command value is input to the motor driver 83 back to the computation of the voltage command value by the controller-1.

The voltage driving of the transfer timing motor 35 is controlled by the motor driver 83, which is constituted by the voltage control driver, and the torque is generated according to the motor voltage and the motor speed.

The voltage command value is determined as being a value corresponding to a torque smaller than the load torque generated by the secondary transfer roller 18 when the print medium 53 is transported by both the secondary transfer roller 18 and the transfer timing roller 38. Thereby, the transfer timing roller 38 does not push the secondary transfer roller 18. The transfer timing roller 38 assists the load torque at which the secondary transfer roller 18 transports the print medium 53 by the driving torque corresponding to the voltage command value. At this time, the tension according to a difference between the load torque of the secondary transfer roller 18 and the driving torque of the transfer timing roller 38 is exerted on the print medium 53.

The relationship between a voltage command value and a load torque of the transfer timing motor 35 will be described. A motor torque T according to a voltage command value and a motor engine speed is represented by the following formula (2).

$$T = \frac{1}{sL + R} \times Kt \times (Volr - Ke \cdot \omega) \tag{2}$$

The following formula (3) is obtained by setting "s" in the above formula (2) to zero in order to obtain the motor torque T of the DC component.

$$T = \frac{1}{R} \cdot Kt \times (Volr - Ke \cdot \omega) \tag{3}$$

The following formula (4) is obtained by rewriting the above formula (3) into the form that represents the motor voltage to the motor torque T.

$$Volr = T \times \frac{R}{Kt} + Ke \cdot \omega \tag{4}$$

As is apparent from the above formula (4), the torque command value of FIG. 12 and the voltage command value of FIG. 14 may be treated equally.

Because the load torque of the secondary transfer roller 18 varies depending on the linear speed (transporting speed) or the kind of the print medium 53, a set of voltage command values associated with various linear speeds and various kinds of the print medium 53 respectively is stored beforehand in the ROM or HDD of the motor control unit 81. By storing the table of such voltage command values in the ROM or HDD, the motor control unit 81 is configured to select and read a voltage command value from the table in accordance with the linear speed and the kind of the print medium 53 which are received from the main controller unit 78.

In this embodiment, a fixed voltage command value is supplied. Alternatively, the motor control unit 81 may be arranged to adjust a voltage command value. In the alternative embodiment, the motor control unit 81 of the transfer timing roller 38 measures a load current or a load torque of the secondary transfer roller 18, and determines a voltage command value to be supplied to the transfer timing roller 38 based on the measured load current or torque. The voltage command value determined by the motor control unit 81 using the above formula (4) is slightly smaller than a load torque corresponding to the measured load current of the secondary transfer roller 18 or the measured load torque of the secondary transfer roller 18 (for example, a value in a range of 90% to 98% of the load torque).

Alternatively, the motor control unit 81 may be arranged to include an observer, instead of directly measuring the load current or the load torque of the secondary transfer roller 18. The observer is provided to estimate a load current or a load torque of the secondary transfer roller 18. When the load current or the load torque is estimated, it is preferred that a low pass filter is arranged between the output of the observer and the input of the motor control unit 81. This helps the motor control unit 81 to be robust to noise.

Embodiment 4

In the Embodiments 1-3, the transfer timing roller 38 or the registration roller 33 has been considered as an upstream roller and the secondary transfer roller 18 has been considered as a downstream roller. Alternatively, the secondary transfer roller 18 may be considered as an upstream roller and the fixing roller 12 may be considered as a downstream roller. In the Embodiments 1-3, the upstream roller is controlled to operate as a follower roller. In this embodiment, the image forming device 100 is arranged to control a downstream roller to operate as a follower roller of an upstream roller.

Figure 15:
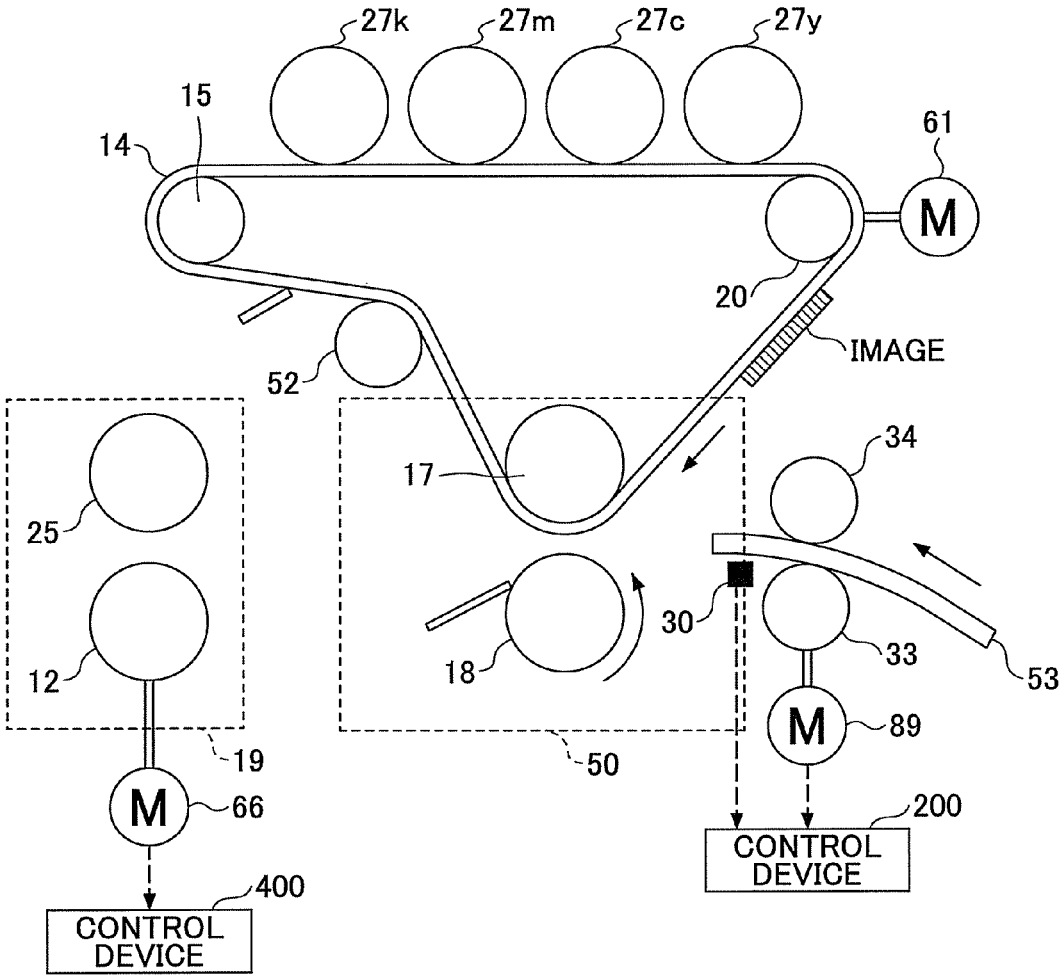
FIG. 15 is a diagram for explaining a structure of a secondary transfer roller and a fixing roller.

FIG. 15 illustrates a structure of the secondary transfer roller 18 and the fixing roller 12. In FIG. 15, the elements which are essentially the same as corresponding elements in FIG. 3 are designated by the same reference numerals, and a description thereof will be omitted.

As illustrated in FIG. 15, at a downstream location of the secondary transfer part 50 in the transport direction of a print medium 53, the fixing unit 19 is arranged, and this fixing unit 19 fixes a toner image to the print medium 53 to which the toner image is transferred by the secondary transfer part 50.

The fixing unit 19 includes a fixing roller 12 and a pressurizing roller 25. The fixing roller 12 is rotated by a fixing motor 66. When the size of the print medium 53 in the transport direction is larger than a predetermined size, the print medium 53 enters the fixing unit 19 before completely passing through the secondary transfer part 50. In this case, the print medium 53 is transported in an overlapping condition by both the secondary transfer part 50 and the fixing unit 19, and torque interference between the secondary transfer part 50 and the fixing unit 19 may take place.

In order to reduce the torque interference, the control device 400 is arranged to control the fixing roller 12 to operate as a follower roller of the secondary transfer roller 18. Thereby, the influence on the surface speed of the intermediate transfer belt 14 can be reduced more effectively than when the rotating speed of the secondary transfer roller 18 is controlled to cause the secondary transfer roller 18 to operate as a follower roller of the fixing roller 12.

As previously described in the Embodiments 1-3, the control of the rotating speed of the upstream roller may be applied to the secondary transfer roller 18. In the case of FIG. 15, the secondary transfer roller 18 is considered as an upstream roller and the fixing roller 12 is considered as a downstream roller. In this case, when the print medium 53 is transported in an overlapping condition by both the secondary transfer roller 18 and the fixing roller 12, the motor control unit 84 of the secondary transfer roller 18 performs the control that is the same as that of the Embodiments 1-3 and causes the secondary transfer roller 18 to operate as a follower roller of the fixing roller 12.

Figure 16:
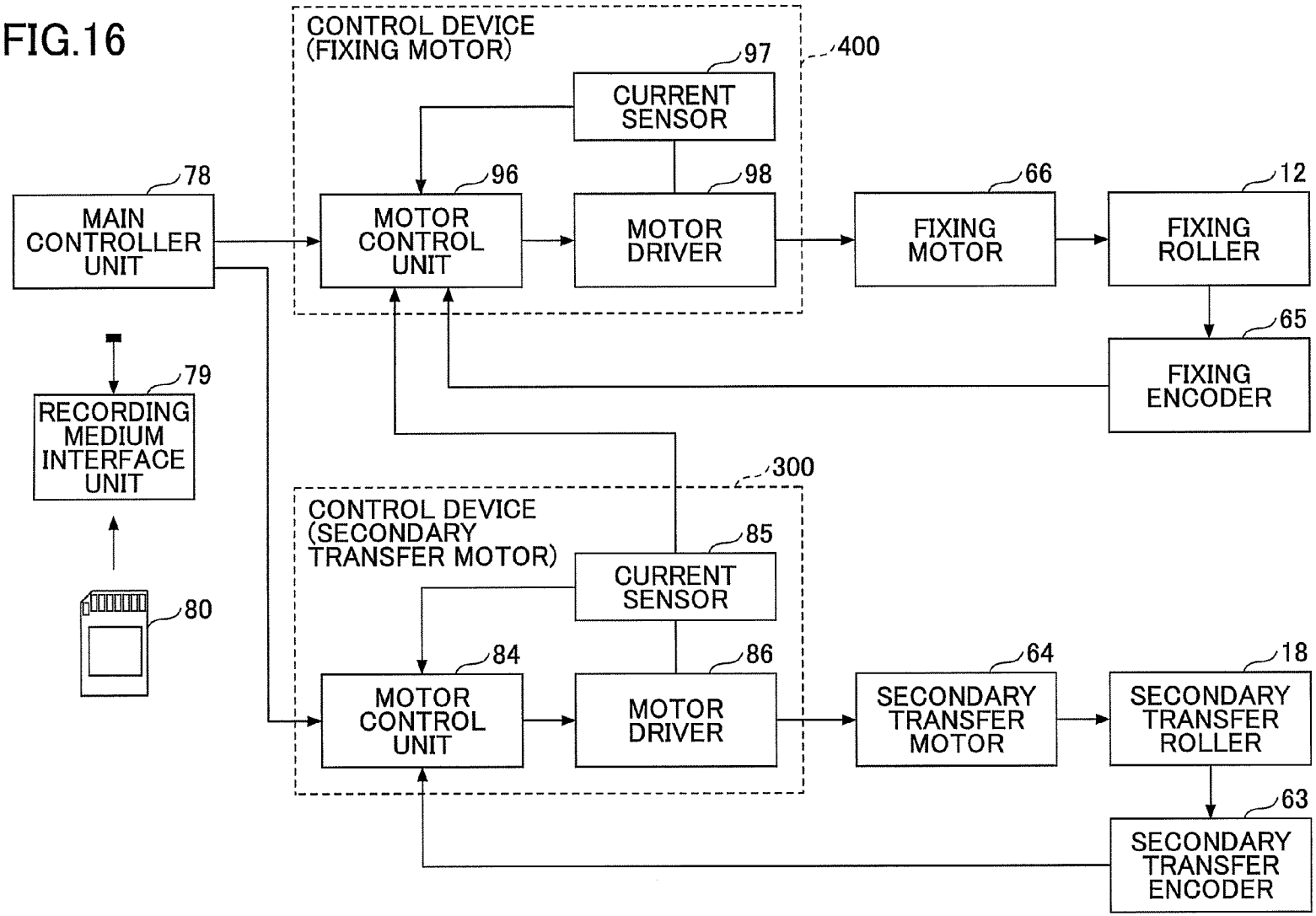
FIG. 16 is a diagram illustrating the hardware composition of a control device.

FIG. 16 illustrates the hardware composition of the control device 400. The control device 400 adjusts the peripheral speed of the fixing roller 12 to a target speed. In FIG. 16, a description of the elements which are the same as corresponding elements in FIG. 5 will be omitted. In the composition of FIG. 16, the fixing roller 12 is connected to the control device 400, instead of the transfer timing roller 38, and the fixing motor 66 is connected to the control device 400, instead of the transfer timing motor 35. Because the control block of the control device 400 is essentially the same as that of FIG. 6, FIG. 12 or FIG. 14, a description thereof will be omitted.

When it is detected that the print medium 53 has entered the fixing roller 12, the motor control unit 96 of the fixing roller 12 of FIG. 16 performs the control that is the same as that of the Embodiments 1-3 (the integration constant ki=0 and the proportionality constant kp=½; a torque command value or a voltage command value is supplied).

When the integration constant ki=0 is set up, the rotating speed of the fixing roller 12 is smaller than the target speed by a disturbance (steady load) such as friction acting on the fixing roller 12. Namely, as in the Embodiment 1, a steady speed error occurs. If the print medium enters the fixing roller 12 with a steady speed error, the rotating speed of the fixing roller 12 is increased by the entering torque, and the steady speed error becomes small. However, the peripheral speed of the fixing roller 12 is smaller than the peripheral speed of the secondary transfer roller 18. The print medium tends to be compressed between the fixing roller 12 and the secondary transfer roller 18, and the fixing roller 12 does not act to pull the print medium 53 from the secondary transfer roller 18. When the print medium is a cardboard sheet, the peripheral speed of the fixing roller 12 may be equivalent to that of the secondary transfer roller 18. However, the fixing roller 12 in this case also does not act to pull the print medium 53 from the secondary transfer roller 18.

When the integration constant ki=0 is set up, the secondary transfer roller 18 acts to push the print medium 53 in the direction toward the fixing roller 12 (it is assumed that the print medium does not bend), and therefore the fixing roller 12 is controlled to operate as a follower roller of the secondary transfer roller 18.

Similarly, when the proportionality constant kp=½ is set up, the rotating speed of the fixing roller 12 tends to be smaller than the target speed by a disturbance (steady load) such as friction acting on the fixing roller 12. The motor control unit 96 switches the controller-1 to the controller-2. If the print medium enters the fixing roller 12 with a speed error, the rotating speed of the fixing roller 12 is increased by the entering torque, and the speed error becomes small. However, if the proportionality constant kp=½ is set up, the gain falls in the whole frequency regions of the control system, and the condition that the peripheral speed of the fixing roller 12 is lower than the peripheral speed of the secondary transfer roller 18 is maintained. For this reason, the print medium tends to be compressed between the fixing roller 12 and the secondary transfer roller 18, and the fixing roller 12 does not act to pull the print medium 53 from the secondary transfer roller 18.

When the proportionality constant kp=½ is set up, the response frequency becomes small and the gain falls. The compensation by the motor control unit 96 of the fixing motor 66 to fluctuation (AC component) of the rotating speed generated by the secondary transfer roller 18 becomes small.

Therefore, the influence of the torque of the fixing roller 12 on the secondary transfer roller 18 can be reduced. It is possible to improve the transient response of the control system when the print medium 53 has entered the fixing roller 12.

When the motor control unit 96 of the fixing roller 12 supplies a torque command value or a voltage command value to the motor driver 98, the procedure is the same as that of the Embodiment 3. Namely, the motor control unit 96 of the fixing roller 12 changes the torque command value to a value smaller than the load torque generated by the secondary transfer roller 18, when the print medium 53 is transported by both the secondary transfer roller 18 and the fixing roller 12. In the case of supplying a voltage command value, the torque value into which the voltage command value is converted is changed to a value smaller than the load torque generated by the secondary transfer roller 18.

In this manner, the fixing roller 12 does not act to pull the secondary transfer roller 18. The fixing roller 12 assists the load torque at which the secondary transfer roller 18 transports the print medium 53 using the driving torque of the torque command value or the driving torque corresponding to the voltage command value. At this time, compression according to a torque difference obtained by subtracting the torque command value of the fixing roller 12 from the load torque of the secondary transfer roller 18 is exerted on the print medium 53.

A set of torque command values or voltage command values may be stored beforehand in the motor control unit 96. The method of determining the torque command value or the voltage command value as in the Embodiment 3 may be applied to this embodiment.

Figure 17:
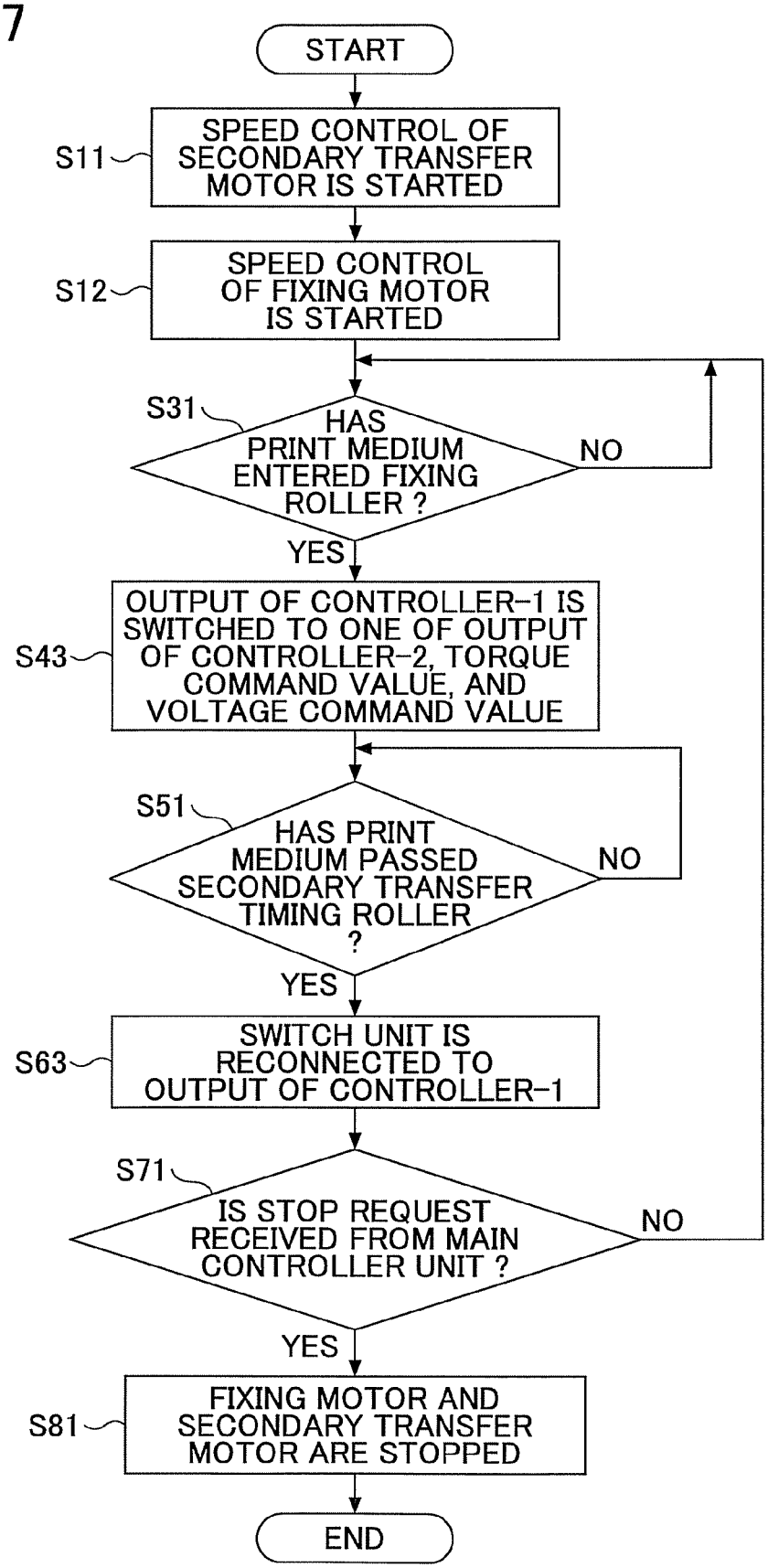
FIG. 17 is a flowchart for explaining a procedure in which a motor control unit controls a rotating speed of a fixing roller.

FIG. 17 is a flowchart for explaining a procedure in which the motor control unit 96 of the fixing motor 66 controls a rotating speed of the fixing roller 12.

The main controller unit 78 transmits a driving command to each of the motor control units 84 and 96. When the driving command is received, the motor control unit 84 starts control of a rotating speed of the secondary transfer motor 64 (S11).

Subsequently, the motor control unit 96 starts control of a rotating speed of the fixing motor 66 (S21).

Subsequently, the motor control unit 96 determines whether the print medium 53 has entered the fixing roller 12 (S31). The method of determining whether the print medium 53 has entered the fixing roller 12, used at this time, may be one of the following methods:

(a) the timing at which the registration roller 33 or the transfer timing roller 38 has started transporting of the print medium 53 is detected; and (b) the driving current detected by the current sensor 97 of the motor driver 98 of the fixing motor 66 is monitored.

In the determining method of (a) above, the motor control unit 96 compares the elapsed time after the print medium 53 has passed the registration roller 33 or the transfer timing roller 38 with a reference period which is stored beforehand, and determines that the print medium 53 has entered the fixing roller 12 based on a result of the comparison. Alternatively, the print-medium passage detecting sensor 37 may be used for this determination.

When the determining method of (b) above is used, the motor control unit 96 monitors the driving current of the fixing motor 66. For example, when a change of the driving current value is larger than a predetermined value, the motor control unit 96 determines that the print medium 53 has entered the fixing roller 12.

When it is determined in step S31 that the print medium 53 has entered the fixing roller 12, the motor control unit 96 switches the output of the controller-1 to one of the output of the controller-2, the torque command value, and the voltage command value (S43). This control enables the fixing roller 12 to operate as a follower roller of the secondary transfer roller 18.

Subsequently, the motor control unit 96 of the fixing motor 66 determines whether the print medium 53 has passed the fixing roller 12 (S51). The method of determining whether the print medium 53 has passed the fixing roller 12, used at this time, may be one of the following methods:

(c) the timing at which the whole print medium 53 has passed the fixing roller 12 is estimated; and (d) the driving current which is detected by the current sensor 97 of the motor driver 98 of the fixing motor 66 is monitored.

When it is determined in step S51 that the print medium 53 has passed the fixing roller 12, the motor control unit 96 causes the switching unit to be reconnected to the output of the controller-1 (S63).

Subsequently, each of the motor control units 84 and 96 determines whether a stop request of the secondary transfer roller 18 and the fixing roller 12 has been received from the main controller unit 78 (S71). For example, reception of a stop request output from the main controller unit 78 means that the printing of the print medium 53 is completed or means that a paper jam takes place.

When it is determined in step S71 that a stop request of the secondary transfer roller 18 and fixing roller 12 from the main controller unit 78 is not received, the motor control units 84 and 96 repeat performing the steps S30 to S71. Specifically, printing of a second or subsequent print medium 53 is repeated.

When it is determined in step S71 that a stop request of the secondary transfer roller 18 and fixing roller 12 is received from the main controller unit 78, each of the motor control units 84 and 96 terminates the procedure (S81). Hence, the secondary transfer roller 18 and the fixing roller 12 are stopped.

As described above, when the print medium 53 is transported in an overlapping condition by the downstream roller and the upstream roller, the upstream roller is controlled to operate as a follower roller of the downstream roller, and it is possible to prevent compression in the print medium 53 or slipping of the print medium 53 on the upstream roller or the downstream roller.

In this embodiment, transporting of the print medium 53 has been described. The transport device or transport method according to the present disclosure is suitably applicable to transporting of a glass sheet or an iron sheet the two rollers.

As described in the foregoing, it is possible to provide a transport device, an image forming device, a transport method, and a recording medium which are capable of reducing torque interference between a downstream roller and an upstream roller.

The present disclosure is not limited to the specifically disclosed embodiments, and variations and modifications may be made without departing from the scope of the present disclosure.

The present application is based on Japanese patent application No. 2009-210982, filed on Sep. 11, 2009, the contents of which are incorporated herein by reference in their entirety.

What is claimed is:

1. A transport device, comprising:

a first transport roller unit that transports a sheet-like print medium along a transport path in a transporting direction;

a second transport roller unit that is disposed at one of a downstream location and an upstream location of the first transport roller unit along the transport path and transports the print medium in the transporting direction;

a first roller driving unit that rotates the first transport roller unit;

a second roller driving unit that rotates the second transport roller unit;

a first speed control unit that controls a rotating speed of the first roller driving unit to reach a first target speed; and a second speed control unit that controls a rotating speed of the second roller driving unit to reach a second target speed, wherein the second speed control unit is arranged to perform, when the print medium is transported by both the first transport roller unit and the second transport roller unit, a follower control having a response sensibility to speed fluctuations in a predetermined frequency region of a control system, which is smaller than a response sensibility when the print medium is transported by the second transport roller unit solely.

2. The transport device according to claim 1, wherein the follower control provides a steady difference between the second target speed and the rotating speed of the second roller driving unit.

3. The transport device according to claim 2, wherein the first speed control unit controls the rotating speed of the first roller driving unit according to PI control to reach the first target speed, the second speed control unit controls the rotating speed of the second roller driving unit according to PI control to reach the second target speed, and a gain of I control during the follower control is smaller than a gain of I control of the second speed control unit when the print medium is transported by the second transport roller unit solely.

4. The transport device according to claim 1, wherein a response frequency of the follower control is smaller than a response frequency when the print medium is transported by the second transport roller unit solely.

5. The transport device according to claim 4, wherein the first speed control unit controls the rotating speed of the first roller driving unit according to PI control to reach the first target speed, the second speed control unit controls the rotating speed of the second roller driving unit according to PI control to reach the second target speed, and a gain of P control during the follower control is smaller than a gain of P control of the second speed control unit when the print medium is transported by the second transport roller unit solely.

6. The transport device according to claim 5, wherein a gain of I control during the follower control is smaller than a gain of I control of the second speed control unit when the print medium is transported by the second transport roller unit solely.

7. The transport device according to claim 1, wherein the second speed control unit controls, during the follower control, the rotating speed of the second roller driving unit to reach a rotating speed according to a predetermined steady torque value.

8. The transport device according to claim 7, wherein the predetermined steady torque value is smaller than a value of torque that is received by the first roller driving unit via the print medium.

9. The transport device according to claim 1, wherein the second speed control unit controls, during the follower control, the rotating speed of the second roller driving unit to reach a rotating speed according to a predetermined voltage value.

10. The transport device according to claim 1, wherein the first transport roller unit is a secondary transfer roller of an image forming device and the second transport roller unit is a transfer timing roller or a registration roller of the image forming device.

11. The transport device according to claim 1, wherein the first transport roller unit is a secondary transfer roller of an image forming device and the second transport roller unit is a fixing roller of the image forming device.

12. An image forming device, comprising:

the transport device according to claim 1 which is arranged to transport the print medium; and an image formation unit that is arranged to form an image on the print medium transported by the transport device.

13. A transport method for use in a transport device including a first transport roller unit that transports a sheet-like print medium along a transport path in a transporting direction, a second transport roller unit that is disposed at one of a downstream location and an upstream location of the first transport roller unit along the transport path and transports the print medium in the transporting direction, a first roller driving unit that rotates the first transport roller unit, a second roller driving unit that rotates the second transport roller unit, a first speed control unit that controls a rotating speed of the first roller driving unit to reach a first target speed, and a second speed control unit that controls a rotating speed of the second roller driving unit to reach a second target speed, the transport method comprising:

detecting, by the second speed control unit, whether the print medium is transported by both the first transport roller unit and the second transport roller unit; and performing, by the second speed control unit, when it is detected that the print medium is transported by both the first transport roller unit and the second transport roller unit, a follower control having a response sensibility to speed fluctuations in a predetermined frequency region of a control system, which is smaller than a response sensibility when the print medium is transported by the second transport roller unit solely.

14. A non-transitory computer-readable recording medium storing a program which, when executed by a computer, causes the computer to perform a transport method for use in a transport device including a first transport roller unit that transports a sheet-like print medium along a transport path in a transporting direction, a second transport roller unit that is disposed at one of a downstream location and an upstream location of the first transport roller unit along the transport path and transports the print medium in the transporting direction, a first roller driving unit that rotates the first transport roller unit, a second roller driving unit that rotates the second transport roller unit, a first speed control unit that controls a rotating speed of the first roller driving unit to reach a first target speed, and a second speed control unit that controls a rotating speed of the second roller driving unit to reach a second target speed, the transport method comprising:

detecting, by the second speed control unit, whether the print medium is transported by both the first transport roller unit and the second transport roller unit; and performing, by the second speed control unit, when it is detected that the print medium is transported by both the first transport roller unit and the second transport roller unit, a follower control having a response sensibility to speed fluctuations in a predetermined frequency region of a control system, which is smaller than a response sensibility when the print medium is transported by the second transport roller unit solely.

* * * * *